US010406804B2

(12) United States Patent
Nakahara

(10) Patent No.: US 10,406,804 B2
(45) Date of Patent: Sep. 10, 2019

(54) PRINTING APPARATUS, PRINTING METHOD, AND NON-TRANSITORY COMPUTER-READABLE RECORDING MEDIUM

(71) Applicant: CASIO COMPUTER CO., LTD., Shibuya-ku, Tokyo (JP)

(72) Inventor: Shota Nakahara, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/824,549

(22) Filed: Nov. 28, 2017

(65) Prior Publication Data

US 2018/0178508 A1 Jun. 28, 2018

(30) Foreign Application Priority Data

Dec. 26, 2016 (JP) ..... 2016-251988

(51) Int. Cl.
*B41J 2/21* (2006.01)
*B41J 2/51* (2006.01)
(Continued)

(52) U.S. Cl.
CPC ..... *B41J 2/04505* (2013.01); *B41J 2/04586* (2013.01); *B41J 2/2132* (2013.01);
(Continued)

(58) Field of Classification Search
CPC ..... B41J 3/36
See application file for complete search history.

(56) References Cited

U.S. PATENT DOCUMENTS 6,070,962 A * 6/2000 Kinoshita ..... B41J 2/04 347/14
8,985,724 B2 3/2015 Takagi et al.
(Continued)

FOREIGN PATENT DOCUMENTS

JP 2013067160 A 4/2013
JP 2016060103 A 4/2016

OTHER PUBLICATIONS

Japanese Office Action dated Jun. 5, 2018 (and an English translation thereof) issued in counterpart Japanese Application No. 2016-251988.

(Continued)

*Primary Examiner* — Julian D Huffman
(74) *Attorney, Agent, or Firm* — Holtz, Holtz & Volek PC

(57) ABSTRACT

A printing apparatus comprises a printer that prints an image on a printing medium and a processor that controls printing by the printer.
The printer comprises a first printing array and a second printing array that print the image and are separated along a first direction, and when the printer prints a second image at a position adjacent to a first image after printing the first image while the printer moves in a movement direction which the first printing array is in front, the first image being printed from a first end toward a second end along the first direction, the first image having a first area image disposed at the first end side, the second area image disposed at the second end side, and a third area image disposed between the first area image and the second area image, the second image being printed from a third end toward a fourth end, the second image having a fourth area image disposed at the third end side, a fifth area image disposed at the fourth end side, and a sixth area image disposed between the fourth area image and the fifth area image, the processor causes printing of the second area image by the second printing array to be performed in parallel with printing of the fourth area image by the first printing array.

19 Claims, 24 Drawing Sheets

(51) Int. Cl.

| | |
|---|---|
| ***B41J 3/36*** | (2006.01) |
| ***B41J 3/54*** | (2006.01) |
| ***B41J 2/045*** | (2006.01) |

(52) U.S. Cl.
CPC . *B41J 3/36* (2013.01); *B41J 3/54* (2013.01); *B41J 2/51* (2013.01)

(56) References Cited

U.S. PATENT DOCUMENTS

| | | | |
|---|---|---|---|
| 9,440,452 | B2 | 9/2016 | Harada et al. |
| 2009/0160894 | A1 | 6/2009 | Barnard et al. |
| 2013/0063512 | A1 | 3/2013 | Takagi et al. |

OTHER PUBLICATIONS

Extended European Search Report (EESR) dated Jun. 8, 2018 issued in counterpart European Application No. 17208634.0.

* cited by examiner

PRINTING APPARATUS, PRINTING METHOD, AND NON-TRANSITORY COMPUTER-READABLE RECORDING MEDIUM

CROSS-REFERENCE TO RELATED APPLICATION

This application claims the benefit of Japanese Patent Application No. 2016-251988, filed on Dec. 26, 2016, the entire disclosure of which is incorporated by reference herein.

FIELD

This disclosure relates to a printing apparatus, a printing method, and a non-transitory computer-readable recording medium.

BACKGROUND

A printing apparatus is known that prints an image on a printing medium in accordance with movement of the printing apparatus on the printing medium.

For example, Unexamined Japanese Patent Application Kokai Publication No. 2016-060103 discloses a handheld printer that, while moving on the printing medium, prints an image on the printing medium by discharging ink from each nozzle of each nozzle array of an inkjet recording head that has at least two nozzle arrays which are disposed side by side.

When the same image is repeatedly printed while moving the handheld printer described in the aforementioned reference, due to spacing of each nozzle array of the recording head, white lines are generated at the boundaries between the printed images. Printing quality worsens due to the generation of the white lines.

SUMMARY

According to the present embodiment, a printing apparatus, a printing method, and a non-transitory computer-readable medium can be provided that can obtain good printing quality when an image is repeatedly printed using a recording head that has multiple printing arrays.

In order to obtain the aforementioned advantages, the printing apparatus of the present disclosure comprising:

a printer that prints an image on a printing medium; and a processor that controls printing by the printer;

wherein the printer comprises a first printing array and a second printing array that print the image and are separated by a first length from each other along a first direction and extend along a second direction intersecting the first direction, when the printer prints a second image at a position adjacent to a first image after printing the first image on the printing medium by the first printing array and the second printing array while the printer moves in a movement direction which the first printing array is in front of the second printing array, (1) the first image has a first end and a second end along the first direction, the first image being printed from the first end toward the second end, the first image having a first area image disposed at a side of the first end, the second area image disposed at a side of the second end, and a third area image disposed between the first area image and the second area image, (2) the second image has a third end and a fourth end along the first direction, the second image being printed from the third end toward the fourth end, the second image having a fourth area image disposed at a side of the third end, a fifth area image disposed at a side of the fourth end, and a sixth area image disposed between the fourth area image and the fifth area image, and (3) each of the first area image, the second area image, the fourth area image, and the fifth area image is an image being printed in an area having the first length along the first direction, the processor executes a first control operation in which printing of the second area image in the first image by the second printing array is performed in parallel with printing of the fourth area image in the second image by the first printing array.

In order to obtain the aforementioned advantages, in the printing method executed by the printing apparatus in the present disclosure, the printing apparatus comprises a printer that prints an image on a printing medium, wherein the printer comprises a first printing array and a second printing array that print the image and are separated by a first length from each other along a first direction and extend along a second direction intersecting the first direction, the printing method including:

when the printer prints a second image at a position adjacent to a first image after printing the first image on the printing medium by the first printing array and the second printing array while the printer moves in a movement direction which the first printing array is in front of the second printing array, (1) the first image has a first end and a second end along the first direction, the first image being printed from the first end toward the second end, the first image having a first area image disposed at a side of the first end, the second area image disposed at a side of the second end, and a third area image disposed between the first area image and the second area image, (2) the second image has a third end and a fourth end along the first direction, the second image being printed from the third end toward the fourth end, the second image having a fourth area image disposed at a side of the third end, a fifth area image disposed at a side of the fourth end, and a sixth area image disposed between the fourth area image and the fifth area image, and (3) each of the first area image, the second area image, the fourth area image, and the fifth area image is an image being printed in an area having the first length along the first direction, executing a first control operation in which printing of the second area image in the first image by the second printing array is performed in parallel with printing of the fourth area image in the second image by the first printing array.

In order to obtain the aforementioned advantages, in the non-transitory computer-readable recording medium storing a printing control program that controls a printing apparatus of the present disclosure:

the printing apparatus comprises a printer that prints an image on a printing medium, wherein the printer comprises a first printing array and a second printing array that print the image and are separated by a first length from each other along a first direction and extend along a second direction intersecting the first direction, the printing control program causes the computer to:

when the printer print a second image at a position adjacent to a first image after printing the first image on the printing medium by the first printing array and the second printing array while the printer moves in a movement direction which the first printing array is in front of the second printing array, (1) the first image has a first end and a second end along the first direction, the first image being printed from the first end toward the second end, the first image having a first area image disposed at a side of the first end, the second area image disposed at a side of the second end, and a third area image disposed between the first area image and the second area image, (2) the second image has a third end and a fourth end along the first direction, the second image being printed from the third end toward the fourth end, the second image having a fourth area image disposed at a side of the third end, a fifth area image disposed at a side of the fourth end, and a sixth area image disposed between the fourth area image and the fifth area image, (3) each of the first area image, the second area image, the fourth area image, and the fifth area image is an image being printed in an area having the first length along the first direction, and execute a first control operation in which printing of the second area image in the first image by the second printing array is performed in parallel with printing of the fourth area image in the second image by the first printing array.

BRIEF DESCRIPTION OF THE DRAWINGS

A more complete understanding of this application can be obtained when the following detailed description is considered in conjunction with the following drawings, in which.

DETAILED DESCRIPTION

Figure 1:
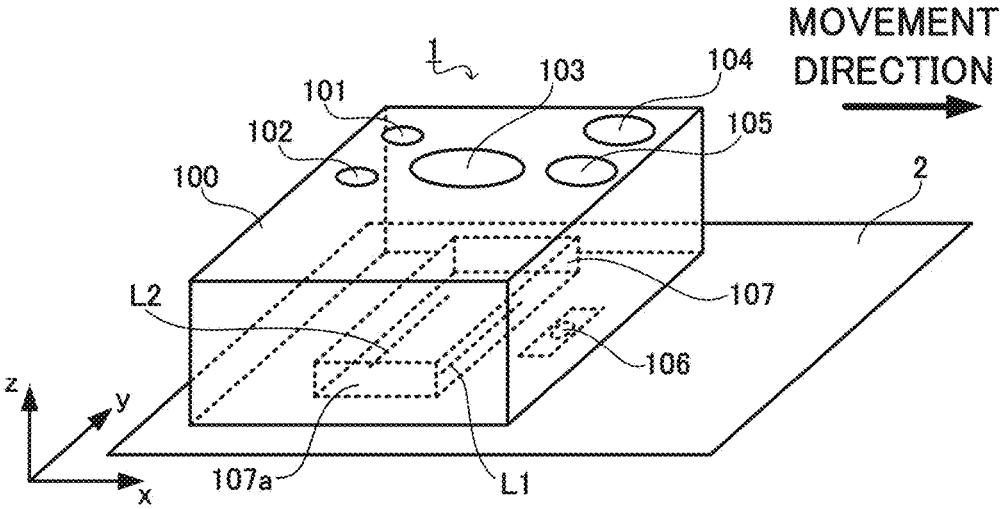
FIG. 1 is a drawing illustrating an external view of a printing apparatus according to an embodiment of the present disclosure.

A printing apparatus according to embodiments of the present disclosure is described below in detail with reference to drawings. In the drawings, the same or equivalent components are each assigned the same reference sign.

A printing apparatus 1 illustrated in FIG. 1 is a manually-scanning-type printing apparatus that can be held and moved on a printing medium 2, and prints an image on the printing medium 2 in accordance with the movement. The manually-scanning-type printing apparatus is also called a handy printer, a handheld printer, and the like. Here, the printing apparatus 1 may be any printing apparatus that moves relative to the printing medium 2. For example, the printing apparatus 1 may have a configuration in which the printing apparatus 1 is fixed and the printing medium 2 is moved relative to the printing apparatus 1.

The direction in which the printing apparatus 1 is moved by the user during printing is called a movement direction, and the movement direction is also called a sub-scanning direction. To facilitate understanding, XYZ coordinate axis is set as illustrated in FIG. 1. An example is described below in which the user moves the printing apparatus 1 relative to the printing medium 2 in the X-axis direction as the movement direction.

Figure 2:
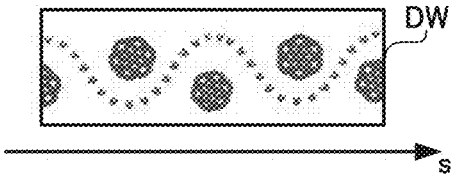
FIG. 2 is a drawing illustrating an example of a printed image.

An image printed on the printing medium 2 by the printing apparatus 1 is also called a print image, a print pattern, and the like. Specific examples of the printed image include a character, a figure, a symbol, a pattern, a picture, a combination thereof, and the like. Hereinafter, an example is described in which the printing apparatus 1 prints a single-unit image DW illustrated in FIG. 2. To facilitate understanding, an S coordinate axis is set as illustrated in FIG. 2. The S-axis direction corresponds to the X-axis direction in FIG. 1. Hereinafter, the S-axis direction is called the rightward direction.

The printing medium 2 is an object on which the image DW is printed during printing. The printing medium 2 is also called a printed medium, a recording medium, a printing object, and the like. Specific examples of the printing medium 2 include a paper, a cloth, a synthetic resin, a cardboard, a box, a bottle, and the like. The printing apparatus 1 that is the manually-scanning-type printing apparatus can print on more varieties of the printing medium 2 than a stationary-type printing apparatus that prints while conveying the printing medium 2. In other words, the printing apparatus 1 can not only print on the printing medium 2 such as paper that is easily conveyed, just as stationary printing apparatus can, but also print on the printing medium 2 such as a cloth, a synthetic resin, a cardboard, a box, a bottle, and the like that has a material, shape, weight, and the like that makes conveyance difficult and thus cannot be printed easily by the stationary-type printing apparatus.

The printing apparatus 1 prints the image DW on the printing medium 2 by performing normal printing processing or loop printing processing. Normal printing processing is a printing processing that is suitable for printing a single-unit image DW one time. The loop printing processing is a printing processing that is suitable for printing the single-unit image DW repeatedly for an arbitrary number of times in accordance with movement of the printing apparatus 1 on the printing medium 2. Details of the normal printing processing and the loop printing processing are described below.

As illustrated in FIG. 1, the printing apparatus 1 includes an apparatus body 100, a first light emitting diode (LED) 101, a second LED 102, a print button 103, a loop switch button 104, an end button 105, a detecting apparatus 106, and a printer 107.

The apparatus body 100, also called as a housing and the like, is held by the user during printing. The apparatus body 100 comprises a bottom surface and an upper surface. The bottom surface is a surface positioned to face the printing medium 2 during printing. The upper surface is a surface that faces the bottom surface.

The first LED 101, the second LED 102, the print button 103, the loop switch button 104, and the end button 105 are disposed on the upper surface of the apparatus body 100.

The first LED 101 is turned on response to pushing down of the print button 103 and notifies the user that execution of the normal printing processing or the loop printing processing is in progress. The turned-on first LED 101 is turned off in response to pushing down of the end button 105 and notifies the user of completion of the normal printing processing or the loop printing processing.

The second LED 102 is turned on in response to an odd number of pushing down of the loop switch button 104 after power of the printing apparatus 1 is turned on and notifies the user that the loop printing processing is selected as the printing method. The turned-on second LED 102 is turned off in response to an even number of pushing down of the loop switch button 104 after power of the printing apparatus 1 is turned on and notifies the user that the normal printing processing is selected as the printing method.

The print button 103 receives an instruction to execute the normal printing processing and an instruction to execute the loop printing processing.

The loop switch button 104 receives an operation to select the loop printing processing as the printing method and an operation to cancel the selection. Specifically, the loop printing processing is selected as the printing method in response to an odd number of pushing down of the loop switch button 104 after power of the printing apparatus 1 is turned on. This selection is canceled in response to an even number of pushing down of the loop switch button 104 after power of the printing apparatus 1 is turned on.

The end button 105 receives an instruction to end printing.

The detecting apparatus 106 and the printer 107 are disposed at the bottom surface of the apparatus body 100.

The detecting apparatus 106 includes a laser-type optical sensor, for example, and outputs a detection signal to a below-described control apparatus 108 at each sampling period. The detection signal includes a movement amount detection signal indicating a movement amount and a movement direction of the printing apparatus 1. The sampling period is previously set in accordance with performance of the laser-type optical sensor. Specifically, the detecting apparatus 106 irradiates laser light onto the surface of the printing medium 2 and uses an image sensor to image laser light reflected by the surface of the printing medium 2. By analyzing interference fringes of the laser light imaged by the image sensor, the detecting apparatus 106 outputs a detection signal that includes the movement amount detection signal. The printing apparatus 1, on the basis of the movement amount detection signal, acquires the movement amount of the printing apparatus 1. The printing apparatus 1 determines, on the basis of whether the detection signal satisfies a lift-off condition, whether the printing apparatus 1 is lifted off. Here, lift off refers to lifting of the printing apparatus 1 during printing and resulting separation from the printing medium 2 by a distance greater than or equal to a preset lift-off distance. The lift-off condition is previously set by an arbitrary method such as experimentation.

The printer 107 prints the image DW on the printing medium 2 by inkjet method in which fine droplets of ink are discharged toward the printing medium 2.

Specifically, the printer 107 comprises an inkjet head 107*a*. The inkjet head 107*a* is also called the print head and the like. The inkjet head 107*a*, in accordance with control by a below-described inkjet head control circuit 107*b*, executes printing by discharging ink loaded in a non-illustrated ink tank toward the printing medium 2. Note that the inkjet head 107*a* and the ink tank are sometimes collectively called an ink cartridge and the like.

Figure 3:
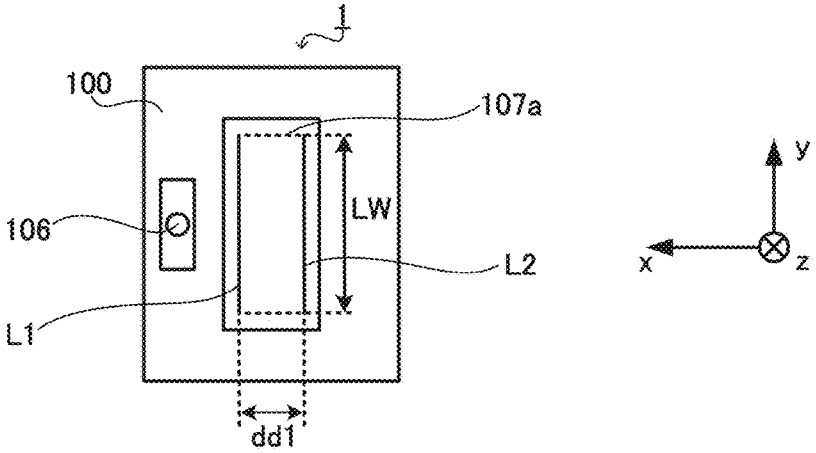
FIG. 3 is a bottom surface view of the printing apparatus of the embodiment of the present disclosure.

More specifically, as illustrated in FIG. 3, the inkjet head 107*a* comprises a first nozzle array L1 (first printing array) and a second nozzle array L2 (second printing array). The first nozzle array L1 is disposed at a position separated by a first nozzle array gap dd1 (first length) along the X-axis direction from the second nozzle array L2. The first nozzle array L1 and the second nozzle array L2 are oriented along the Y-axis direction. Let LW be length of the first nozzle array L1 and the second nozzle array L2 in the Y-axis direction.

Figure 4:
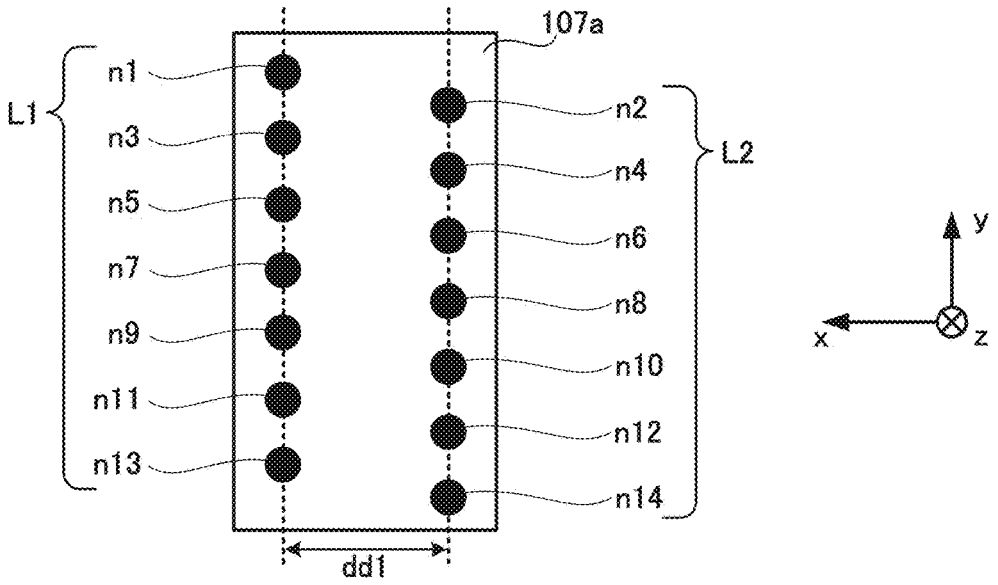
FIG. 4 is a drawing illustrating an external view of an inkjet head included in the printing apparatus according to the embodiment of the present disclosure.

As illustrated in FIG. 4, the first nozzle array L1 and the second nozzle array L2 comprise ink nozzles n1 to n14 disposed along straight lines extending along the Y axis. The ink inside the ink nozzles n1 to n14 is heated to form bubbles, and bursting of the bubbles causes discharging of the ink from the ink nozzles n1 to n14 toward the printing medium 2.

Numbers are assigned to each of the ink nozzles n1 to n14 in order to distinguish from each other. The first nozzle array L1 comprises the odd-numbered ink nozzles n1, n3, . . . n13. The second nozzle array L2 comprises the even-numbered ink nozzles n2, n4, . . . n14. As illustrated in FIG. 4, the ink nozzles n1, n3, . . . n13 included in the first nozzle array L1 are disposed away from the ink nozzles n2, n4, . . . n14 included in the second nozzle array L2 in the Y-axis direction by half of a length between each of the ink nozzles n2, n4, . . . n14 in the Y-axis direction. Thus in comparison to a printing apparatus that comprises only one nozzle array, the printing apparatus 1 can print the image DW at higher printing resolution. This point is described below.

The printing resolution of the printing apparatus 1 depends on the number of ink droplets that the printing apparatus 1 is capable of discharging per unit distance along the Y-axis direction. Thus in order to improve the printing resolution of a printing apparatus 1 that comprises only one nozzle array, ink nozzles in the nozzle array need to be disposed with narrowed length between each of the ink nozzles. However, narrowing of the length between each of the ink nozzles beyond a fixed limit is difficult due to structural constraint. Thus the printing resolution of the printing apparatus that comprises only one nozzle array naturally has an upper limit.

In contrast, the printing apparatus 1, comprising the aforementioned configuration, can discharge ink droplets by the ink nozzles n2, n4, . . . n14 included in the second nozzle array L2 in gaps between ink droplets discharged by the ink nozzles n1, n3, . . . n13 included in the first nozzle array L1. Thus the printing apparatus 1 can achieve a printing resolution equivalent to a case in which the ink nozzles n2, n4, . . . n14 included in the second nozzle array L2 are disposed in the gaps between the ink nozzles n1, n3, . . . n13 included in the first nozzle array L1. Thus the printing apparatus 1 can print the image DW at a higher printing resolution in comparison to the printing apparatus that includes only one nozzle array.

Figure 5:
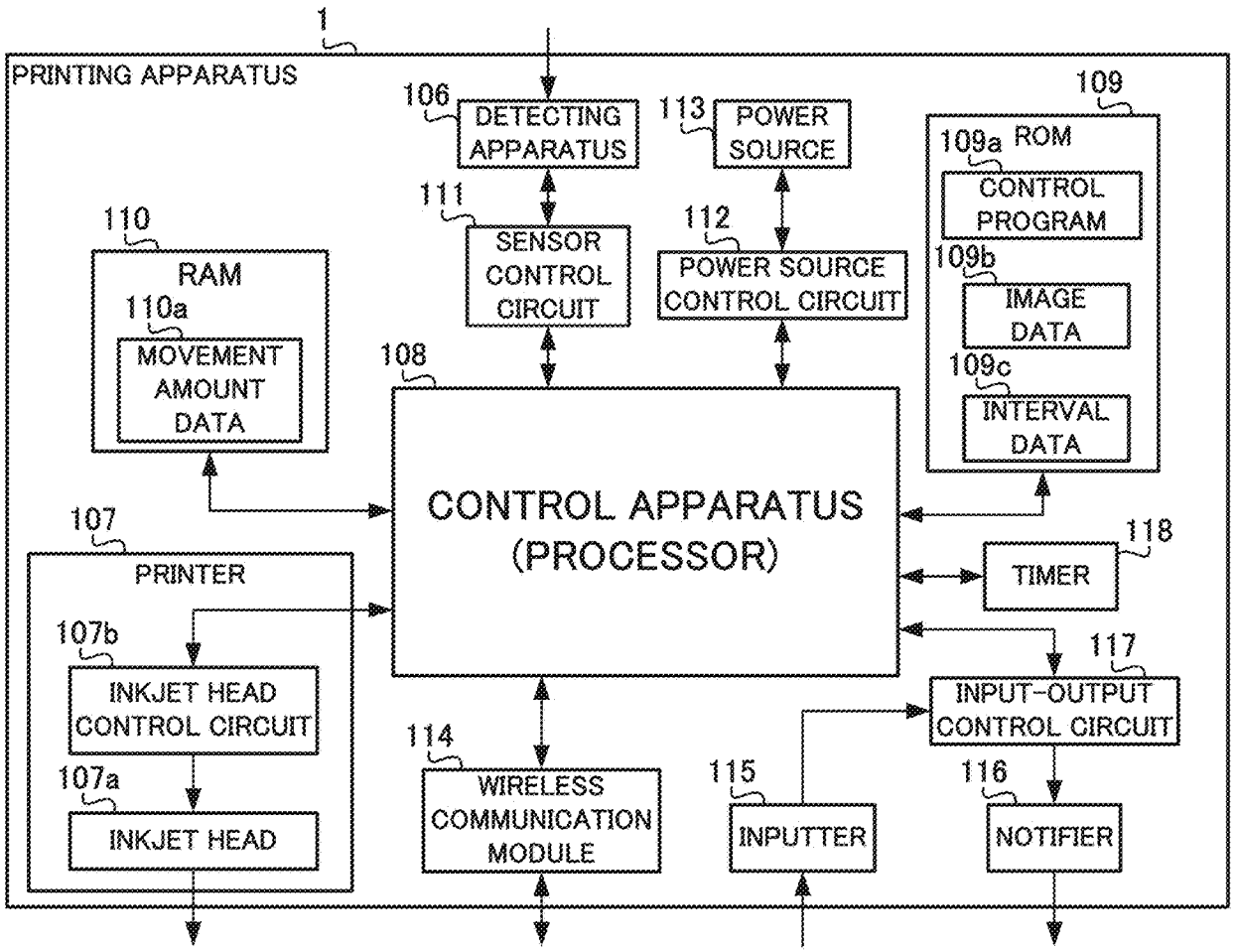
FIG. 5 is a drawing illustrating an electrical configuration of the printing apparatus according to the embodiment of the present disclosure.

As illustrated in FIG. 5, in addition to the aforementioned components, the printing apparatus 1 comprises the control apparatus 108, a read only memory (ROM) 109, a random access memory (RAM) 110, a sensor control circuit 111, a power source control circuit 112, a power source 113, the inkjet head control circuit 107*b*, a wireless communication module 114, an inputter 115, a notifier 116, an input-output control circuit 117, and a timer 118.

The control apparatus 108 is a processor that comprises a central processing unit (CPU) and executes various types of processing including the aforementioned normal printing processing and loop printing processing in accordance with programs and data stored in the ROM 109. The control apparatus 108 is connected to each of component of the printing apparatus 1 via a system bus that is a transmission pathway for commands and data, and performs overall control of the entire printing apparatus 1.

The ROM 109 stores programs and data used by the control apparatus 108 for executing various types of processing. Specifically, the ROM 109 stores a control program 109*a* executed by the control apparatus 108. The ROM 109 stores image data 109*b* representing the image DW. The printing apparatus 1 acquires the image data 109*b* via the wireless communication module 114 from an external device such as a personal computer (PC) or a smart phone and stores the acquired image data 109*b* in the ROM 109. The ROM 109 stores length data 109*c* representing a length of the first nozzle array gap dd1.

The RAM 110 stores data generated or acquired by the control apparatus 108 by executing various types of processing. Specifically, the RAM 110 stores movement amount data 110*a* representing the movement amount of the printing apparatus 1 indicated by the movement amount detection signal. The RAM 110 functions as a working area of the control apparatus 108. In other words, the control apparatus 108 reads out the programs and data to the RAM 110, and executes various types of processing by referencing the read-out programs and data accordingly.

The sensor control circuit 111 controls the detecting apparatus 106 in accordance with control by the control apparatus 108.

The power source control circuit 112 controls the power source 113 in accordance with control by the control apparatus 108.

The power source 113 comprises a battery and supplies power to each component of the printing apparatus 1 in accordance with control by the power source control circuit 112.

The inkjet head control circuit 107*b* is disposed in the printer 107 and controls discharging of the ink by the inkjet head 107*a* in accordance with control by the control apparatus 108. Specifically, the inkjet head control circuit 107*b*, in accordance with control by the control apparatus 108, transmits to the inkjet head 107*a* below-described print data generated on the basis of the image data 109*b*. Then the inkjet head control circuit 107*b* controls conduction dots of the inkjet head 107*a* by a driver integrated circuit (IC) disposed in the inkjet head control circuit 107*b*, causes discharging of the ink from at least one of the ink nozzles n1 to n14, and executes printing.

The wireless communication module 114 performs wireless communication with an external device via a wireless network such as a wireless local area network (LAN). The printing apparatus 1 acquires various types of data including the image data 109*b* from the external device via the wireless communication module 114.

The inputter 115 comprises an input device such as an input key, an operation button, a switch, a touch pad, a touch panel, and the like, and receives various types of operation instructions inputted by the user, and supplies the received operation instructions to the control apparatus 108. Specifically, the inputter 115 comprises a print button 103, a loop switch button 104, and an end button 105, as well as a sensor to detect pushing down of these buttons. The inputter 115 comprises a counter that counts a total number of times that the loop switch button 104 is pushed down after power of the printing apparatus 1 is turned on. The counter resets the count when the power of the printing apparatus 1 is turned off.

The notifier 116 executes various types of notification in accordance with control by the input-output control circuit 117.

The input-output control circuit 117 controls the inputter 115 and the notifier 116 in accordance with control by the control apparatus 108. Specifically, in response to pushing down of the print button 103 of the inputter 115, the input-output control circuit 117 turns on the first LED 101 of the notifier 116 and notifies the user that execution of the normal printing processing or the loop printing processing is in progress. In response to pushing down of the end button 105 of the inputter 115, the input-output control circuit 117 turns off the turned-on first LED 101 and notifies the user that the execution of the normal printing processing or the loop printing processing is ended. In response to an odd number of pushing down of the loop switch button 104 after the power of the printing apparatus 1 is turned on, the input-output control circuit 117 sets a loop flag to the on state, and in response to an even number of pushing down, sets the loop flag to the off state. In response to the setting of the loop flag to the on state, the input-output control circuit 117 turns on the second LED 102 of the notifier 116 and notifies the user that the loop printing processing is selected as the printing method. In response to setting of the loop flag to the off state, the input-output control circuit 117 turns off the turned-on second LED 102 and notifies the user that the normal printing processing is selected as the printing method.

The timer 118 comprises a real time clock (RTC) that continues to clock time even when supply of power by the power source 113 is stopped, and clocks time. The timer 118 supplies data representing results of clocking to the control apparatus 108.

Figure 6:
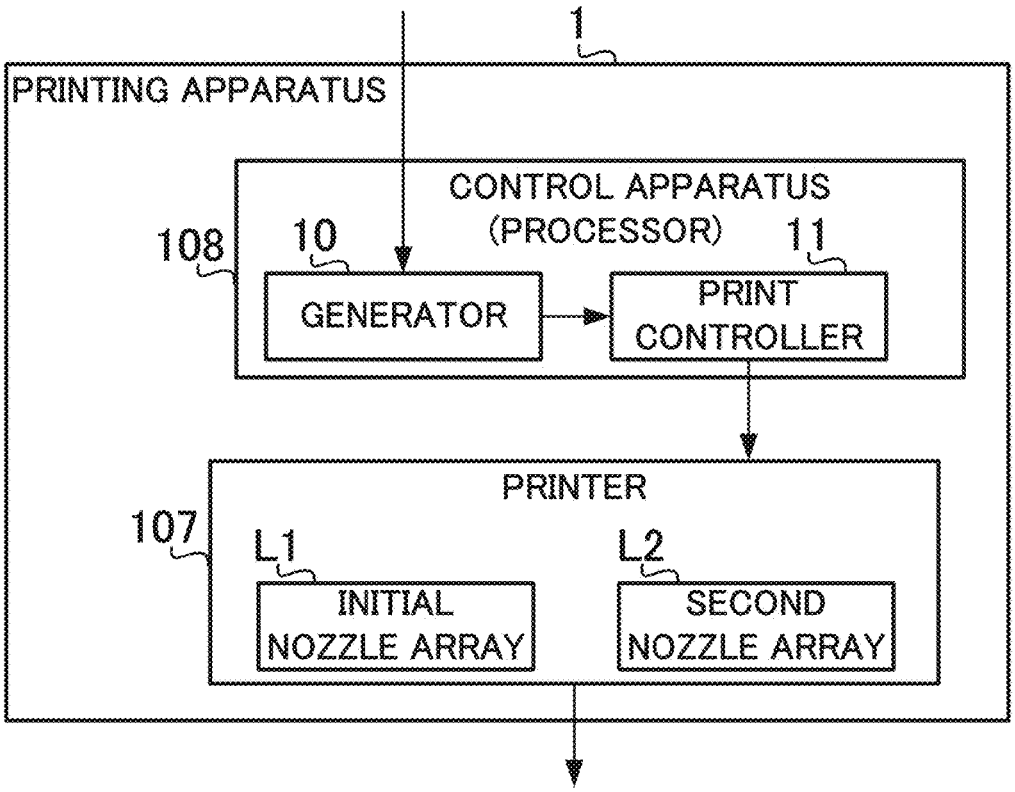
FIG. 6 is a drawing illustrating a functional configuration of the printing apparatus according to the embodiment of the present disclosure.

As illustrated in FIG. 6, the printing apparatus 1 comprising the aforementioned physical configuration comprises a generator 10 and a print controller 11 as functions of the control apparatus 108. The control apparatus 108 functions as these various components by executing the control program 109*a* and controlling the printing apparatus 1.

The generator 10 generates the normal print data and the loop print data. In the normal printing processing, the print controller 11 controls the printer 107 in accordance with the normal print data. In the loop printing processing, the print controller 11 controls the printer 107 in accordance with the loop print data. Each function of the printing apparatus 1 are described below with reference to FIGS. 7A to 16B. Specifically, the normal printing processing is described with reference to FIGS. 7A to 9. The loop printing processing is described with reference to FIGS. 10 to 16B.

Each function of the printing apparatus during execution of the normal printing processing are described with reference to FIGS. 7A to 9.

Figure 7A:
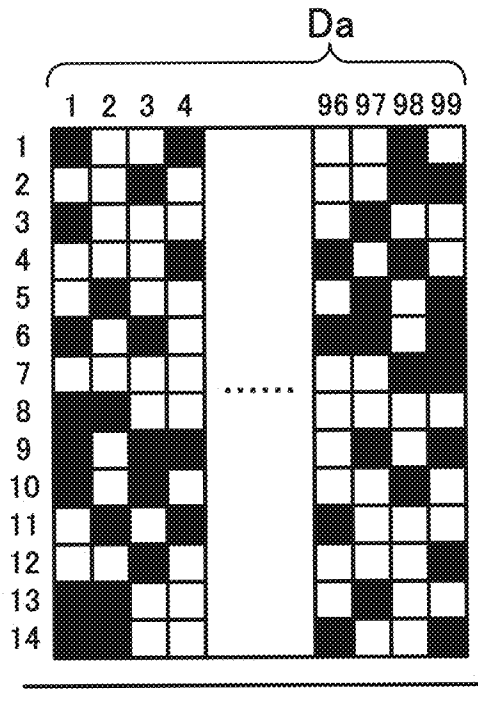
FIG. 7A is a drawing illustrating an example configuration of binary image data.

During generation of the normal print data, the generator 10 firstly, by execution of binarization processing of the image data 109*b*, generates binary image data Da illustrated in FIG. 7A.

To facilitate understanding, U coordinate axis is set as illustrated in FIG. 7A. The U-axis direction corresponds to the X-axis direction in FIG. 1 and the S-axis direction in FIG. 2. Hereinafter, the U-axis direction is referred to as rearward.

The generator 10 sets columns and rows in the binary image data Da. Here, a column corresponds to the vertical direction (columns 1 to 99) in FIG. 7A, and a row corresponds to the lateral direction (rows 1 to 14) in FIG. 7A. The data of each column represents the image DW that the printing apparatus 1 can print without moving. The 1st column, which is the initial column of the binary image data Da, represents the left end of the image DW. The 99th column, which is the last column of the binary image data Da, represents the right end of the image DW. The data of each row is the data corresponding to the nozzles n1 to n14 that each have the same numbering as that of the row. For example, the 3rd ink nozzle n3 executes printing in accordance with the data of the 3rd row.

Figure 7B:
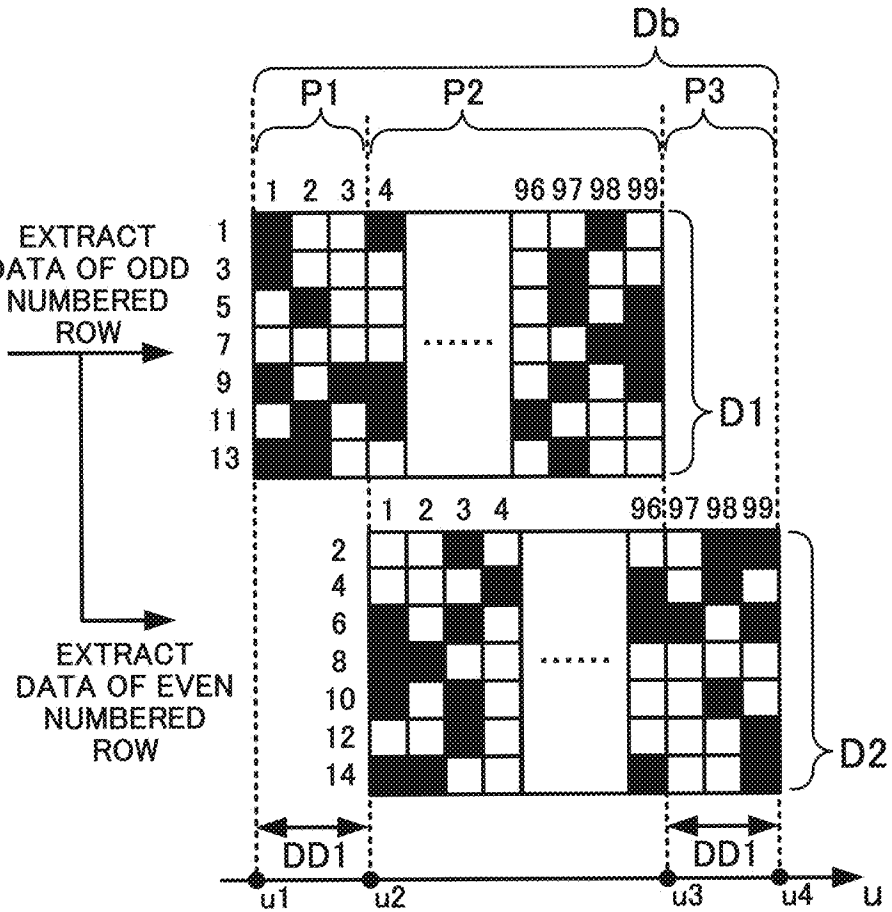
FIG. 7B is a drawing illustrating an example configuration of normal print data used in normal printing processing by the printing apparatus according to the embodiment of the present disclosure.

As illustrated in FIG. 7B, the generator 10 generates the first nozzle array data D1 by extracting data of the odd numbered rows of the binary image data Da, and generates the second nozzle array data D2 by extracting data of the even numbered rows. The first nozzle array data D1 is the print data used for control of the first nozzle array L1. The second nozzle array data D2 is the print data used for control of the second nozzle array L2.

The generator 10 generates the normal print data Db by associating the first nozzle array data D1 and the second nozzle array data D2 so that the 1st column, which is the initial column, of the second nozzle array data D2 is disposed at a data position u2 which is located away from the 1st column, which is the initial column, of the first nozzle array data D1 by the first data interval DD1 in rearward direction. The first data interval DD1 is a distance in the data corresponding to the first nozzle array gap dd1 of the inkjet head 107*a*. The generator 10 acquires the first data interval DD1 on the basis of the length data 109*c*. In the example of FIG. 7B, the first data interval DD1 is a 3-column portion distance in the data. Thus in the normal print data Db illustrated in FIG. 7B, the 1st column of the second nozzle array data D2 is associated with the 4th column of the first nozzle array data D1.

The print controller 11, in accordance with the movement amount of the printing apparatus 1 acquired on the basis of the movement amount detection signal outputted from the detecting apparatus 106, sequentially sets each column of the normal print data Db as a print-target column one-by-one from front to rear. The print controller 11 transmits the normal print data Db of the print-target column to the inkjet head 107*a* of the printer 107. The printer 107 executes the normal printing processing by discharging the ink from the first nozzle array L1 and the second nozzle array L2 in accordance with the received normal print data Db.

Figure 8:
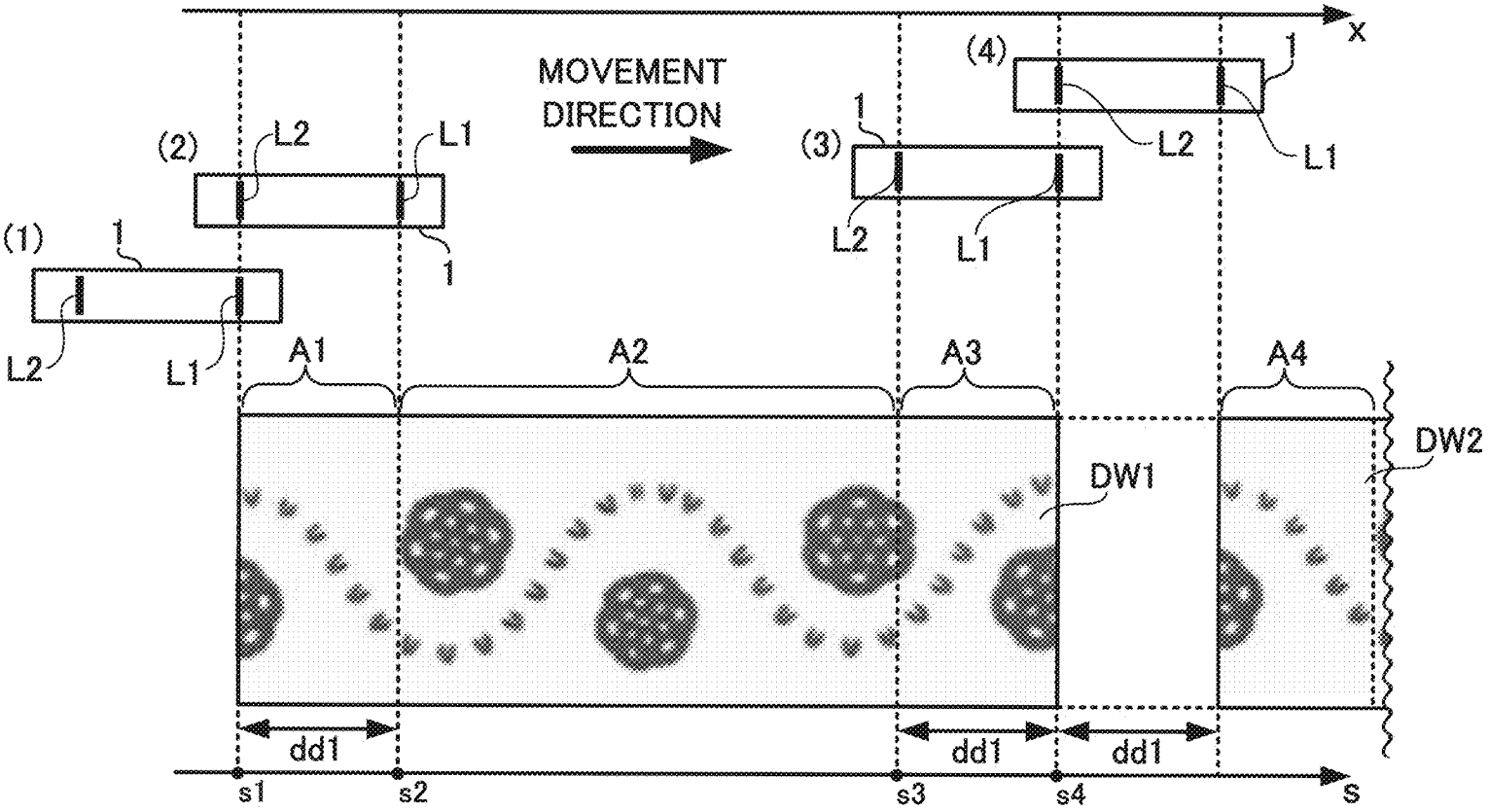
FIG. 8 is a drawing for description of the normal printing processing executed by the printing apparatus according to the embodiment of the present disclosure.

Specifically, in accordance with movement of the printing apparatus 1 from the position (1) to the position (2) illustrated in FIG. 8, by controlling the printer 107 in accordance with the normal print data Db of a first data range P1, the print controller 11 causes the first nozzle array L1 to print an image of a first area A1 in the image DW (indicated as a first image DW1 in FIG. 8). Note that the second nozzle array data D2 is not included in the normal print data Db of the first data range P1, and thus ink is not discharged from the second nozzle array L2, and printing is not performed by the second nozzle array L2.

As illustrated in FIG. 7B, the first data range P1 is a range of data between a data position u1 of the 1st column, which is the initial column, of the first nozzle array data D1 in the normal print data Db and a data position u2 of the 1st column, which is the initial column, of the second nozzle array data D2 in the normal print data Db.

As illustrated in FIG. 8, the image of the first area A1 is an image of an area between a position s1 at the left end of the first image DW1 and a position s2 that is located away from the position s1 by the first nozzle array gap dd1 in the rightward direction along the movement direction. Note that a second image DW2 illustrated in FIG. 8, as described below, is an image that is printed next after the first image DW1 in the case of repeatedly printing the single-unit image DW, and an image of a fourth area A4 is an image in the second image DW2 that corresponds to the image of the first area A1 in the first image DW1.

By controlling the printer 107 in accordance with the normal print data Db of a second data range P2 in accordance with movement of the printing apparatus 1 from the position (2) to the position (3) illustrated in FIG. 8, the print controller 11 causes the first nozzle array L1 to print an image of a third area A2 and an image of a second area A3 in the first image DW1, and causes the second nozzle array L2 to print the image of the first area A1 and the image of the third area A2 in the first image DW1.

As illustrated in FIG. 7B, the second data range P2 is a range of data between the data position u2 and a data position u3 of the 99th column, which is the last column, of the first nozzle array data D1 in the normal print data Db.

As illustrated in FIG. 8, the image of the third area A2 is an image of an area between the position s2 and a position s3, which is located away from a position s4 at the right end of the first image DW1 by the first nozzle array gap dd1 in the leftward direction. The second area A3 is an image of an area between the position s3 and the position s4.

The print controller 11 controls the printer 107 in accordance with the normal print data Db of a third data range P3 in accordance with movement of the printing apparatus 1 from the position (3) to a position (4) illustrated in FIG. 8. Thus the second nozzle array L2 is made to print the image of the second region A3 in the first image DW1. Note that, due to the first nozzle array data D1 not being included in the normal print data Db of the third data range P3, ink is not discharged from the first nozzle array L1, and printing is not performed by the first nozzle array L1, during printing of the image of the second region A3 by the second nozzle array L2.

As illustrated in FIG. 7B, the third data range P3 is a range of data between the data position u3 and a data position u4 of the 99th column, which is the last column, of the second nozzle array data D2 in the normal print data Db.

As described above, the print controller 11 controls the printer 107 in accordance with the normal print data Db generated by the generator 10, causes execution of the normal printing processing to print the single-unit image DW.

The first nozzle array L1 is disposed away from the second nozzle array L2 by the first nozzle array gap dd1 in the movement direction, and always performs printing before the second nozzle array L2 in according with movement of the printing apparatus in the movement direction as illustrated in FIG. 8.

In other words, the second nozzle array L2 prints the image of the position s3 during the first nozzle array L1 printing the image of the position s4 of the first image DW1. Then when the second nozzle array L2 prints the image of the position s4 of the first image DW1 and finishes the printing of the single-unit image DW, the first nozzle array L1 is positioned away from the position s4 by the first nozzle array gap dd1 in the movement direction.

Figure 9:
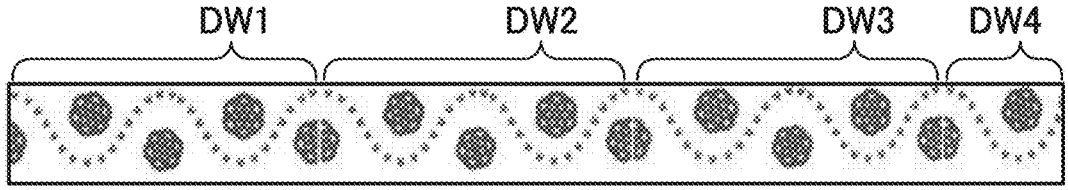
FIG. 9 is a drawing illustrating an example of results of printing of the normal printing processing executed by the printing apparatus according to the embodiment of the present disclosure.

Thus when the single-unit image DW is repeatedly printed while the printing apparatus 1 is moved in the movement direction by the normal printing processing in accordance with the normal print data Db that does not include the second nozzle array data D2 in the first data range P1 and does not include the first nozzle array data D1 in the third data range P3, and thus, as illustrated in FIG. 8 and FIG. 9, the first image DW1, the second image DW2, the third image DW3, and the fourth image DW4 are printed, gaps (white lines) are generated that have a width corresponding to the first nozzle array gap dd1 at the respective boundaries of the printed first image DW1, the second image DW2, the third image DW3, and the fourth image DW4. Printing quality worsens as a result.

Next, each function of the printing apparatus 1 during the execution of the loop printing processing in which the single-unit image DW is repeatedly printed are described with reference to FIGS. 10 to 16B.

Figure 10:
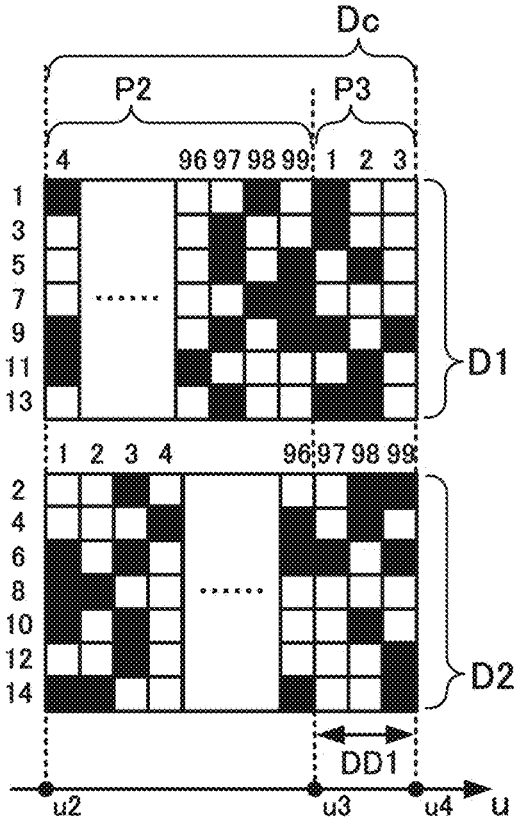
FIG. 10 is a drawing showing an example configuration of loop print data used in loop printing processing by the printing apparatus according to the embodiment of the present disclosure.

The generator 10 copies, the normal print data Db illustrated in FIG. 7B, a first data interval DD1 portion from the 1st column, which is the initial column, of the first nozzle array data D1 (that is, copies the 1st to 3rd columns), and adds the copied data at the rear of the 99th column, which is the last column, of the first nozzle array data DE Then the data of the copying source is erased. Loop print data Dc illustrated in FIG. 10 is generated by this processing.

More specifically, the generator 10 copies the first data range P1 of the normal print data Db. Then the generator 10 calculates a logical sum of the copied data and the third data range P3 of the normal print data Db. The third data range P3 of the loop print data Dc is generated by this processing. In other words, the first nozzle array data D1 is not included in the third data range P3 of the normal print data Db. Thus the third data range P3 of the first nozzle array data D1 included in the loop print data Dc generated by the logical summation has content that is the same as the first data range P1 of the first nozzle array data D1 included in the normal print data Db. The second nozzle array data D2 is not included in the first data range P1 of the normal print data Db. Thus the third data range P3 of the second nozzle array data D2 included in the loop print data Dc generated by the logical summation has content that is the same as the third data range P3 of the second nozzle array data D2 included in the normal print data Db.

The second data range P2 of the loop print data Dc has the same content as the second data range P2 of the normal print data Db.

The print controller 11, in accordance with the movement amount of the printing apparatus 1 acquired on the basis of the movement amount detection signal outputted from the detecting apparatus 106, sequentially sets each column of the loop print data Dc as the print-target column one-by-one from front to rear. When the last column of the loop print data Dc is set as the print-target column, the initial column of the loop print data Dc is set as the print-target column in the next processing. In this manner, printing is repeatedly performed in accordance with the loop print data Dc until an instruction to end printing. The initial column of the loop print data Dc illustrated in FIG. 10 is the 4th column, which is the initial column, of the first nozzle array data D1 and the 1st column, which is the initial column, of the second nozzle array data D2. The last column of the loop print data Dc is the 3rd column, which is the last column, of the first nozzle array data D1 and the 99th column, which is the last column, of the second nozzle array data D2. The print controller 11 transmits the loop print data Dc of the print-target column to the inkjet head 107*a* of the printer 107. By discharging ink from the first nozzle array L1 and the second nozzle array L2 in accordance with the received loop print data Dc, the printer 107 executes the loop printing processing.

Figure 11:
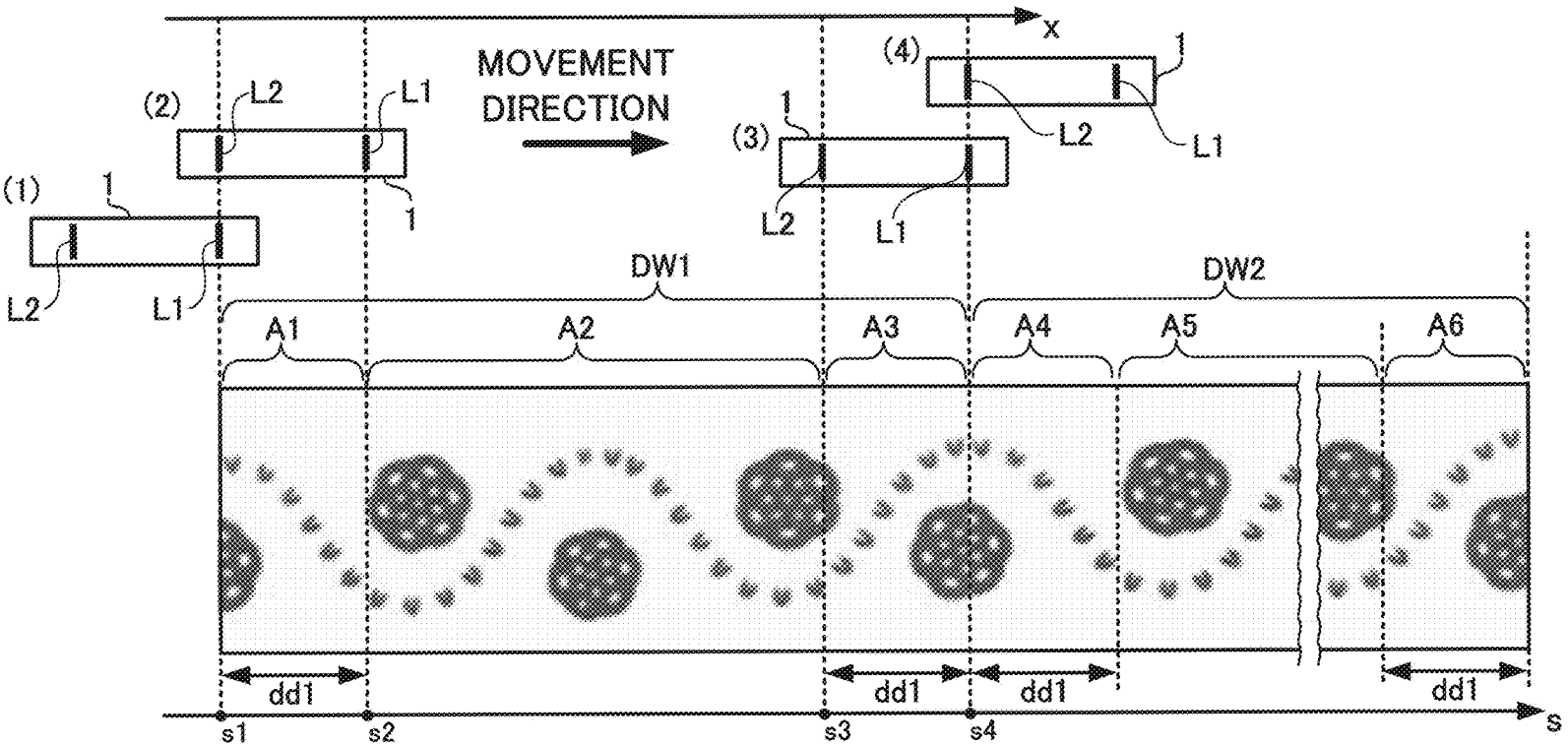
FIG. 11 is a drawing for description of the loop printing processing executed by the printing apparatus according to the embodiment of the present disclosure.

A case in which the second image DW2 is printed at a position adjacent to the first image DW1 after the printing of the first image DW1 is described in reference to FIG. 11. Note that, in FIG. 11, the first image DW1 and the second image DW2 are images that have the same content. Specifically, the print controller 11 controls the printer 107 according to the second data range P2 of the loop print data Dc in accordance with the movement of the printing apparatus 1 from the position (1) to the position (3) illustrated in FIG. 11. Thus the first nozzle array L1 is made to print the image of the third area A2 and the image of the second area A3 in the first image DW1 illustrated in FIG. 11, and the second nozzle array L2 is made to print the image of the first area A1 and the image of the third area A2 in the first image DW1.

The print controller 11 controls the printer 107 according to the data of the third data range P3 of the loop print data Dc in accordance with movement of the printing apparatus 1 from the position (3) to the position (4) illustrated in FIG. 11. Thus the first nozzle array L1 is made to print the image of the fourth area A4 in the second image DW2, and the second nozzle array L2 is made to print the image of the second region A3 in the first image DW1. Note that, the image of the fourth area A4 illustrated in FIG. 11 is an image in the second image DW2 that corresponds to the image of the first area A1 in the first image DW1; an image of the fifth area A6 is an image in the second image DW2 that corresponds to the image of the second area A3 in the first image DW1; and an image of the sixth area A5 is an image in the second image DW2 that corresponds to the image of the third area A2 in the first image DW1.

Figure 12:
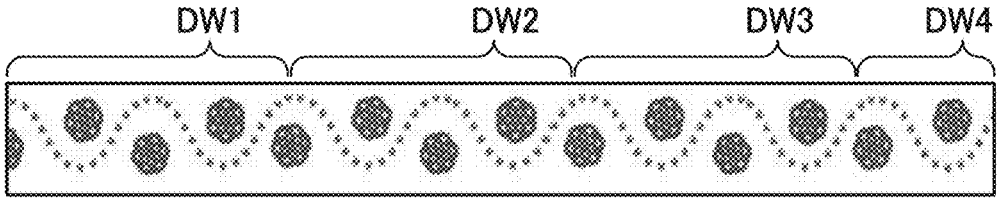
FIG. 12 is a drawing illustrating an example of results of printing of the loop printing processing executed by the printing apparatus according to the embodiment of the present disclosure.

The loop print data Dc, unlike the normal print data Db, does not include blank portion. Thus when the single-unit image DW is repeatedly printed by the loop printing processing in accordance with the loop print data Dc while the printing apparatus 1 is moved in the movement direction, as illustrated in FIG. 12, unlike in the normal printing processing, the generation of white lines at the boundaries between the printed single-unit images DW is suppressed. Thus printing quality is improved in comparison to repeated printing of the single-unit image DW by the normal printing processing.

As described above, the print controller 11 principally causes the printer 107 to execute the loop printing processing by controlling the printer 107 in accordance with the loop print data Dc. However, at the start and the end of the loop printing processing, the print controller 11 executes a different printing operation. This point is described below with reference to FIGS. 13 to 16B.

Firstly, the printing operation executed by the print controller 11 at the start of the loop printing processing is described below with reference to FIG. 13.

When the user pushes down the print button 103 to instruct to execute printing after selecting the loop printing processing as the printing method by pushing down the loop switch button 104 an odd number of times after the power of the printing apparatus 1 is turned on, the print controller 11 starts the loop printing processing. The pushing down of the print button 103 corresponds to the execution of an operation to cause the start of printing.

Figure 13:
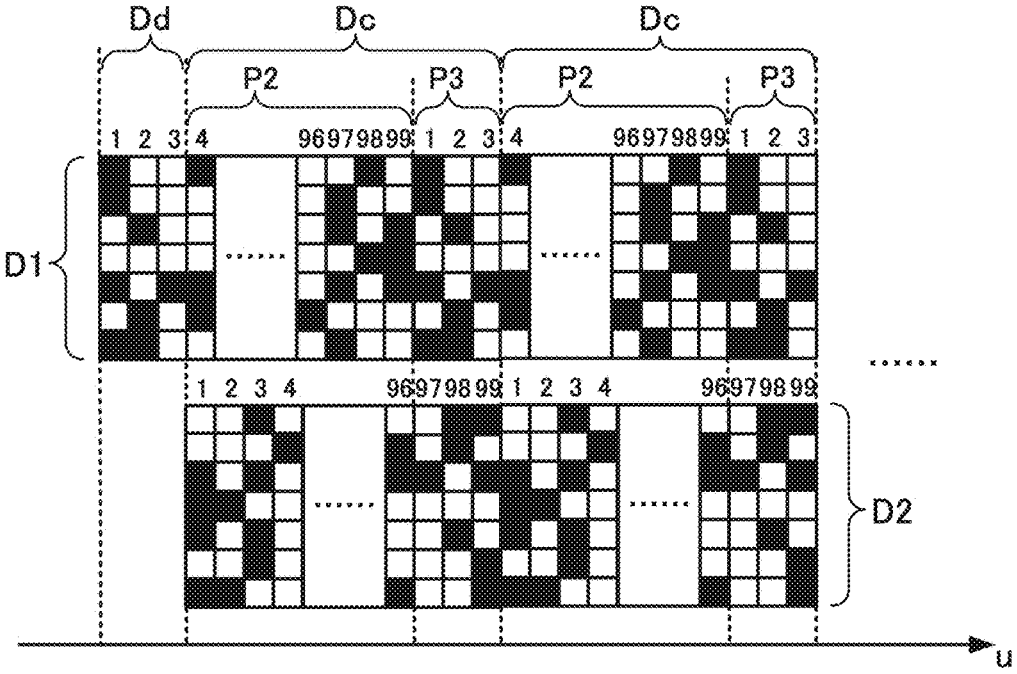
FIG. 13 is a drawing for description of a printing operation executed when the printing apparatus according to the embodiment of the present disclosure begins the loop printing processing.

When the loop printing processing starts, the print controller 11 causes the printer 107 to execute printing by controlling the printer 107 in accordance with start print data Dd illustrated in FIG. 13. The start print data Dd is generated by the generator 10. Specifically, the generator 10 generates the start print data Dd by copying the first data range P1 of the normal print data Db.

By controlling the printer 107 in accordance with the start print data Dd, the print controller 11 causes the first nozzle array L1 to print the image of the first area A1 in the first image DW illustrated in FIG. 11. The second nozzle array data D2 is not included in the start print data Dd, and thus during printing of the image of the first area A1 by the first nozzle array L1, ink is not discharged from the second nozzle array L2 and printing is not performed by the second nozzle array L2.

After causing the printer 107 to execute printing in accordance with the data of the last column of the start print data Dd, the print controller 11 switches the print data to the loop print data Dc and starts control in accordance with the aforementioned loop print data Dc. The last column of the start print data Dd illustrated in FIG. 13 is the 3rd column, which is the last column, of the first nozzle array data D1. Accordingly, printing by the second nozzle array L2 is started. Note that, after switching the print data to the loop print data Dc, the print controller 11 start printing from the initial column of the loop print data Dc.

Next, printing processing executed by the print controller 11 at the end of the loop printing processing is described with reference to FIGS. 14A to 16B.

When the user pushes down the end button 105 to instruct to end printing, the printer controller 11 performs a printing operation corresponding to a state of progress of the printing by the first nozzle array L1 occurring at the time when the end button 105 is pushed down, and then the print controller 11 ends the loop printing processing. The pushing down of the end button 105 corresponds to the execution of an operation to cause the end of printing. Note that, even after the user pushes down the end button 105, the user is assumed to continue moving the printing apparatus 1 in the movement direction for the time being.

Specifically, when the end button 105 is pushed down during printing by the first nozzle array L1 of the image of the third area A2 or the image of the second area A3 in the first image DW1 in FIG. 11, the print controller 11 executes a printing operation that is different from a printing operation executed when the end button 105 is pushed down during printing by the first nozzle array L1 of the image of the fourth area A4 in the second image DW2.

More specifically, when the end button 105 is pushed down during the printing by the first nozzle array L1 of the image of the third area A2 or the image of the second area A3 in the first image DW1, the print controller 11 prints up to the right end of the printing-in-progress single-unit image DW and then ends printing. Hereinafter, the printing operation executed by the print controller 11 when the end button 105 is pushed down during printing by the first nozzle array L1 of the image of the third area A2 or the image of the second area A3 in the first image DW1 is described in detail using an example illustrated in FIG. 14A and FIG. 14B.

Figure 14A:
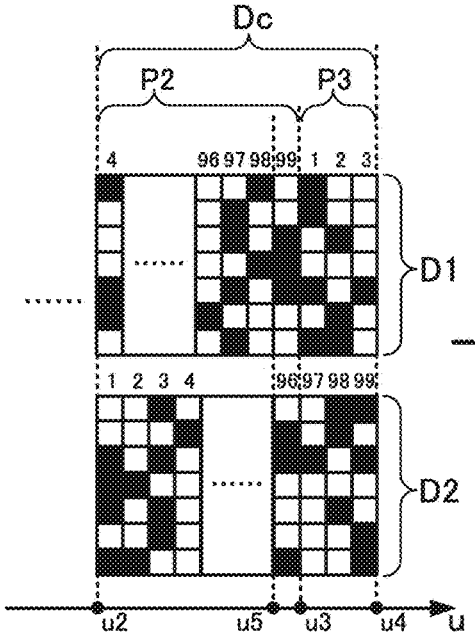
FIG. 14A is a drawing for description of an instruction by a user to end the loop printing processing.
Figure 14B:
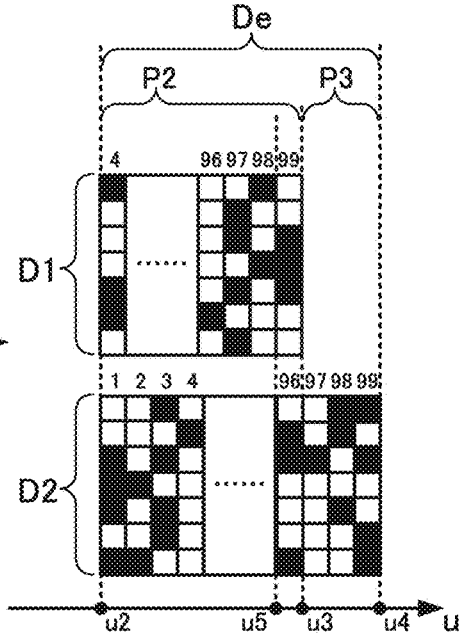
FIG. 14B is a drawing illustrating an example configuration of first end print data used by the printing apparatus according to the embodiment of the present disclosure when ending the loop printing processing.
Figure 15:
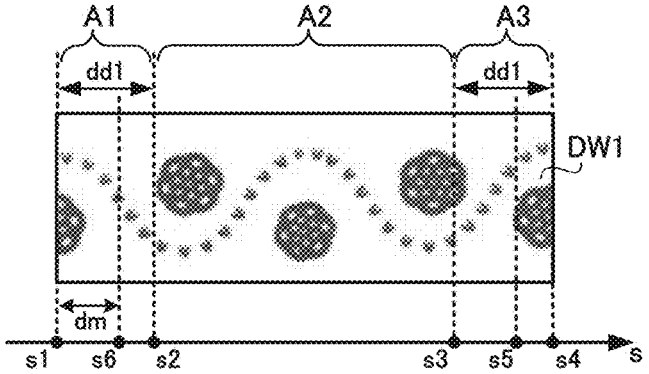
FIG. 15 is a drawing for description of a printing operation executed by the printing apparatus according to the embodiment of the present disclosure when ending the loop printing processing.

FIG. 14A and FIG. 14B illustrate the example in which the end button 105 is pushed down when printing is executed up to a data position u5 illustrated in FIG. 14A in accordance with the loop print data Dc. The data position u5 belongs to the second data range P2. By controlling the printer 107 in accordance with the first nozzle array data D1 of the data position u5, the first image DW1 of a position s5 illustrated in FIG. 15 is printed by the first nozzle array L1. The position s5 belongs to the image of the second area A3.

When the end button 105 is pushed down when printing is executed up to the data position u5 in accordance with the loop print data Dc, the print controller 11 switches the print data to the first end print data De illustrated in FIG. 14B in response. The print controller 11, after switching of the print data, starts printing from a column next to a column corresponding to the data position u5. In response to the printing in accordance with the last column in the first end print data De, the print controller 11 ends the printing. The last column of the first end print data De illustrated in FIG. 14B is the 99th column, which is the last column, of the second nozzle array data D2.

The first end print data De is generated by the generator 10. Specifically, the generator 10 generates the first end print data De by erasing the third data range P3 of the first nozzle array data D1 in the loop print data Dc.

The print controller 11, by controlling the printer 107 in accordance with the first end print data De, causes the first nozzle array L1 to print up to the right end of the image of the second area A3 in the first image DW1. The first nozzle array data D1 is not included in the third data range P3 of the first end print data De, and thus after printing up to the right end of the image of the second area A3 of the first image DW1, discharging of ink from the first nozzle array L1 is halted, and printing by the first nozzle array L1 stops. By controlling the printer 107 in accordance with the first end print data De, the print controller 11 causes the second nozzle array L2 to print up to the right end of the image of the second area A3 in the first image DW1. Upon execution of printing in accordance with the last column of the first end print data De, the print controller 11 ends printing in the aforementioned manner. In response, discharging of ink from the second nozzle array L2 is stopped, and printing by the second nozzle array L2 stops.

By controlling the printer 107 in accordance with the start print data Dd at the start of the loop printing processing, and by controlling the printer 107 in accordance with the first end print data De at the end of the loop printing processing, the print controller 11 suppresses the worsening of printing quality caused by printing of a part of the first image DW1 by only one of the nozzle arrays. By controlling the printer 107 in accordance with the first end print data De after the giving of the instruction to end printing, the print controller 11 ends printing after printing the right end of the printing-in-progress single-unit image DW. As a result, cut off of in-progress printing of the single-unit image DW is suppressed.

On the other hand, when the end button 105 is pushed down while the first nozzle array L1 is printing the image of the fourth area A4 in the second image DW2, the print controller 11 ends printing after printing up to a position in the second image DW2 being printed by the first nozzle array L1 at the time when the end button 105 is pushed down. Hereinafter, the printing processing executed by the print controller 11 when the end button 105 is pushed down during printing by the first nozzle array L1 of the image of the fourth area A4 in the second image DW2 is described in detail using an example illustrated in FIGS. 16A and 16B.

Figure 16A:
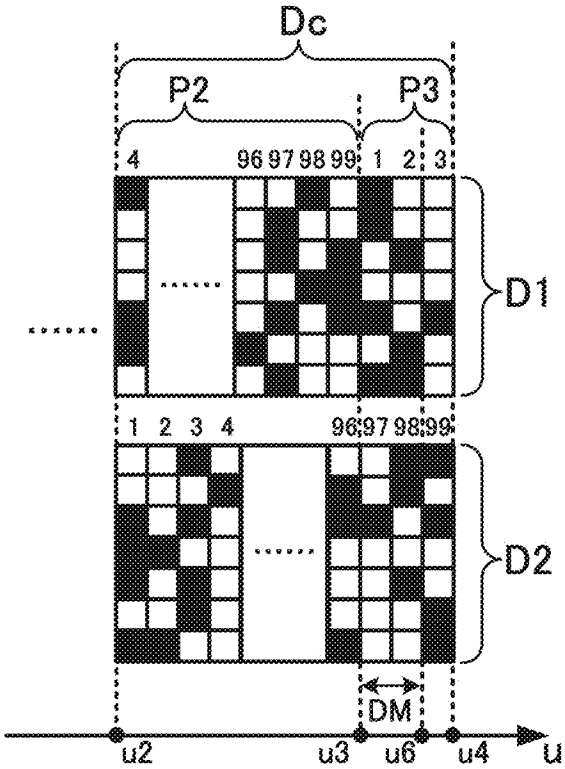
FIG. 16A is another drawing for description of the instruction by the user to end the loop printing processing.
Figure 16B:
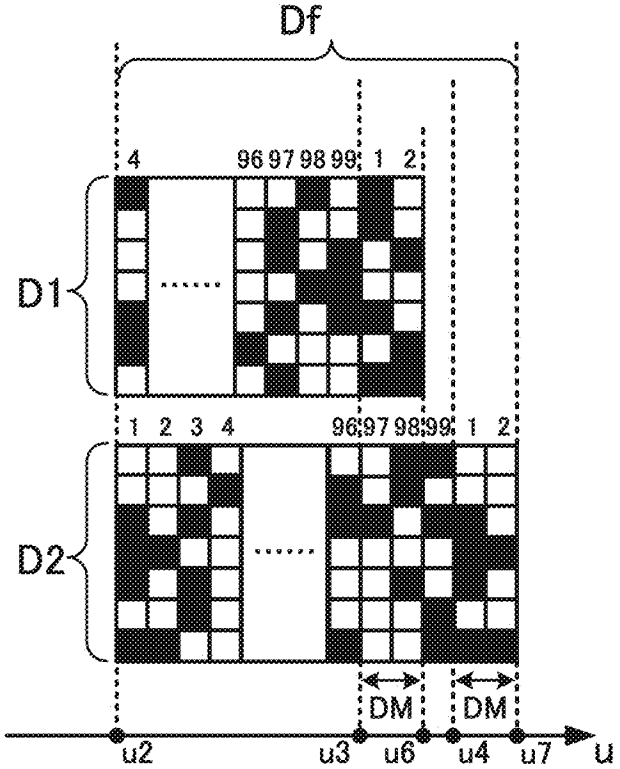
FIG. 16B is a drawing illustrating an example configuration of second end print data used by the printing apparatus according to the embodiment of the present disclosure when ending the loop printing processing.
Figure 17:
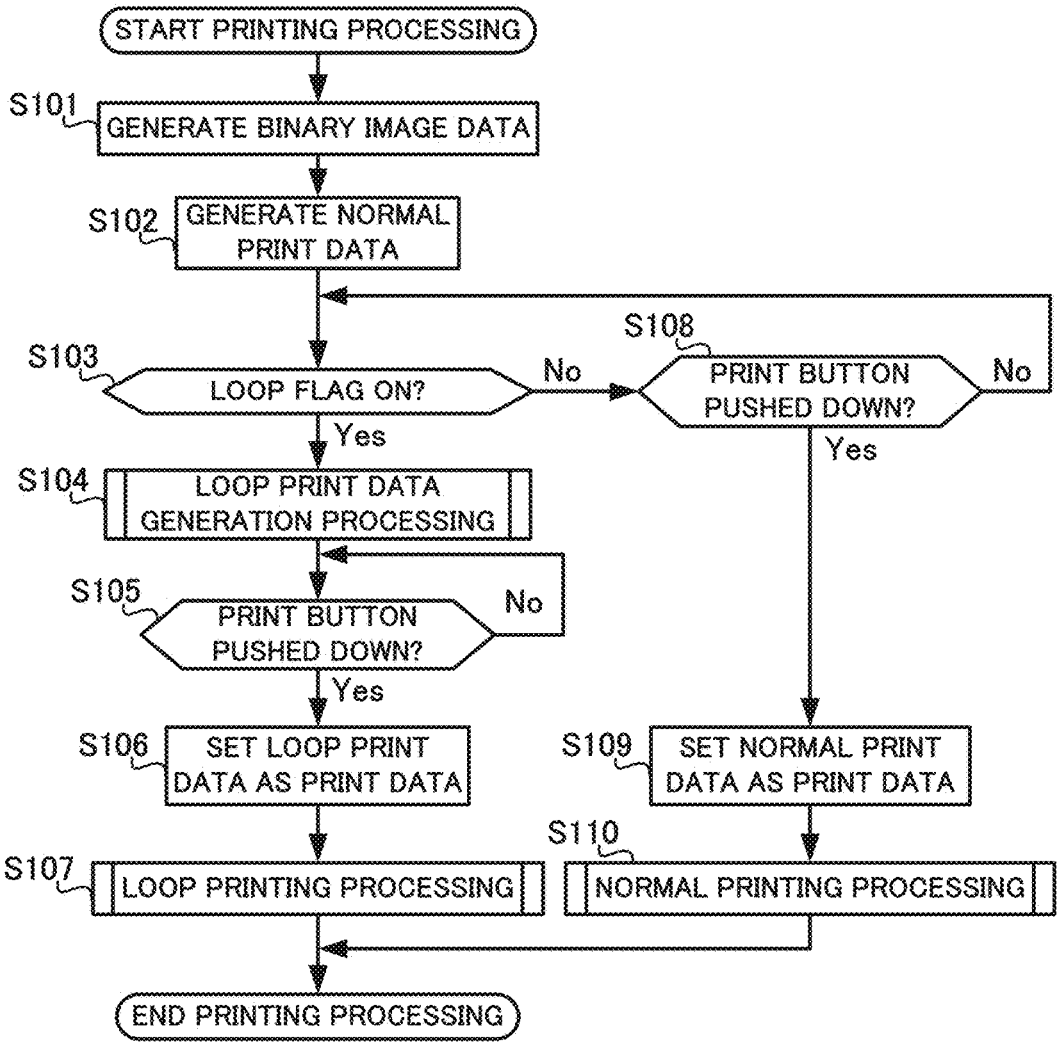
FIG. 17 is a flowchart for description of the printing processing executed by the printing apparatus according to the embodiment of the present disclosure.
Figure 18:
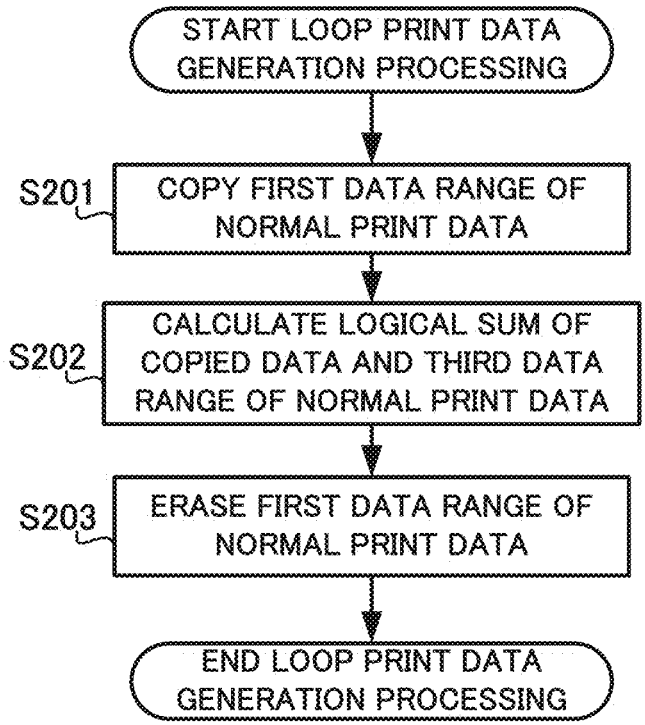
FIG. 18 is a flowchart for description of loop print data generation processing executed by the printing apparatus according to the embodiment of the present disclosure.
Figure 19:
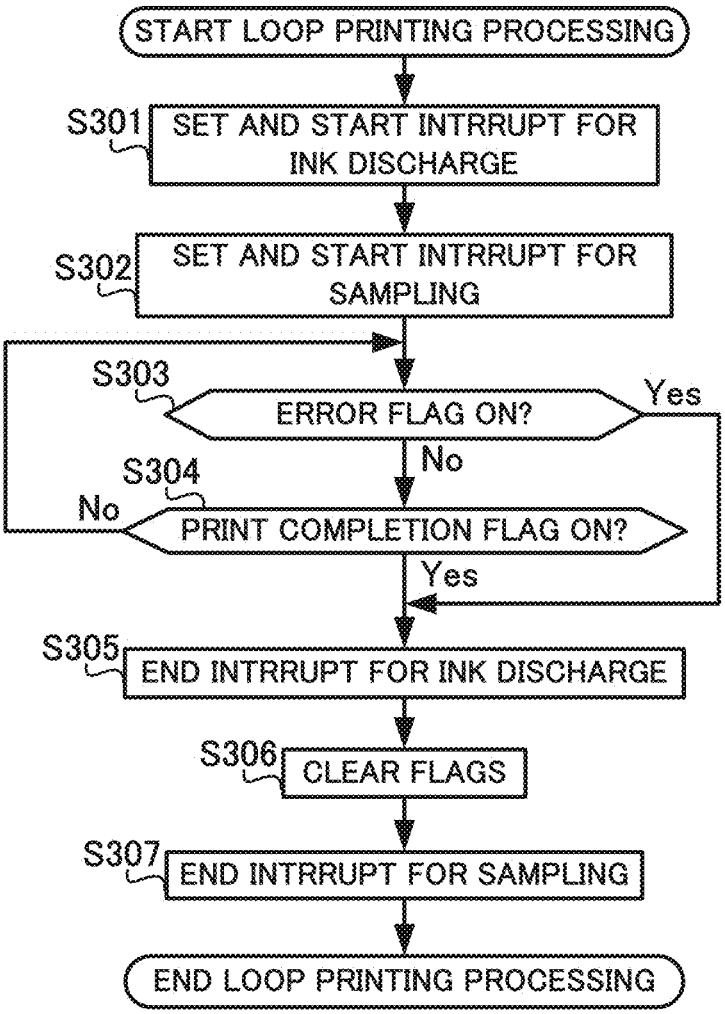
FIG. 19 is a flowchart for description of loop printing processing executed by the printing apparatus according to the embodiment of the present disclosure.
Figure 20:
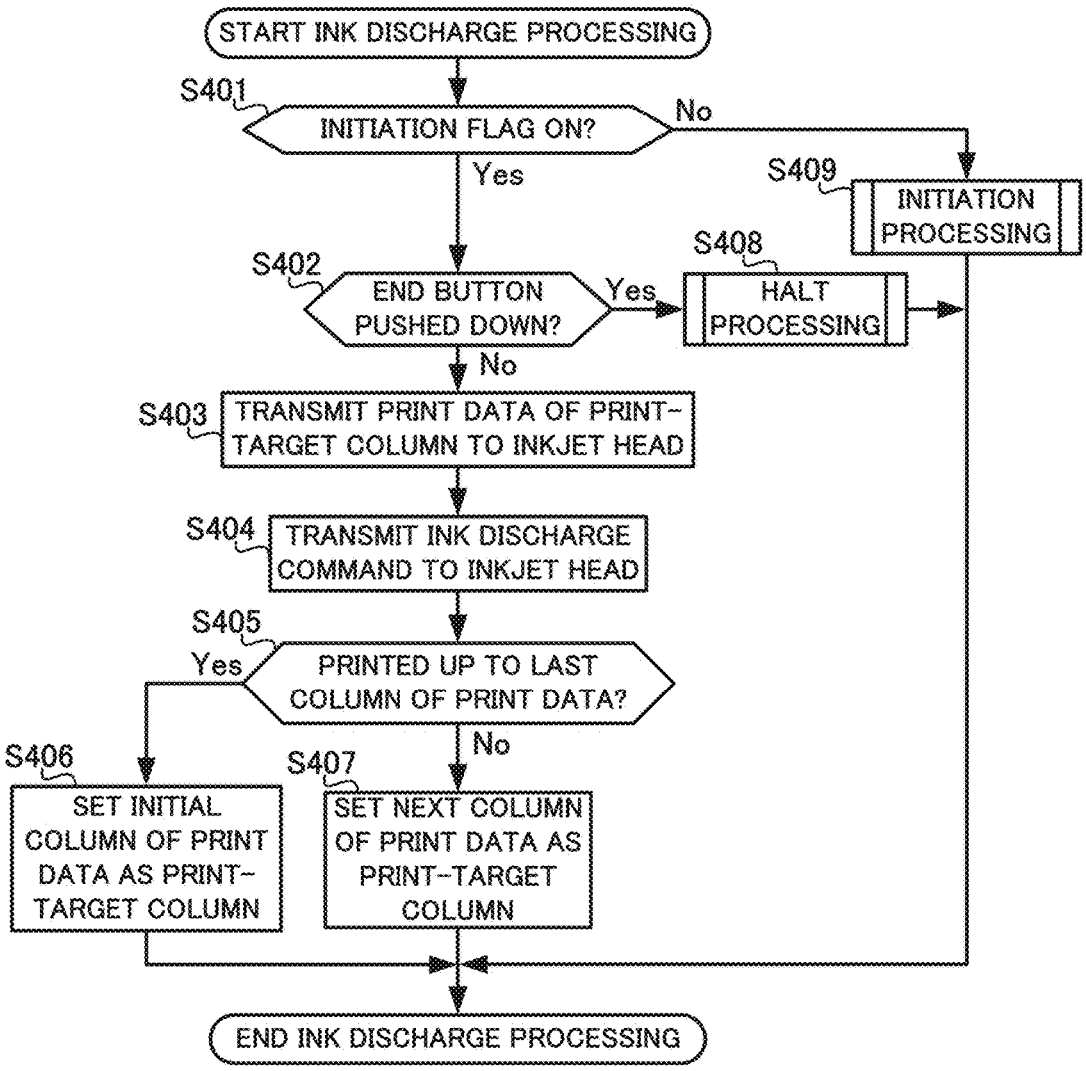
FIG. 20 is a flowchart for description of ink discharge processing executed by the printing apparatus according to the embodiment of the present disclosure in the loop printing processing.
Figure 21:
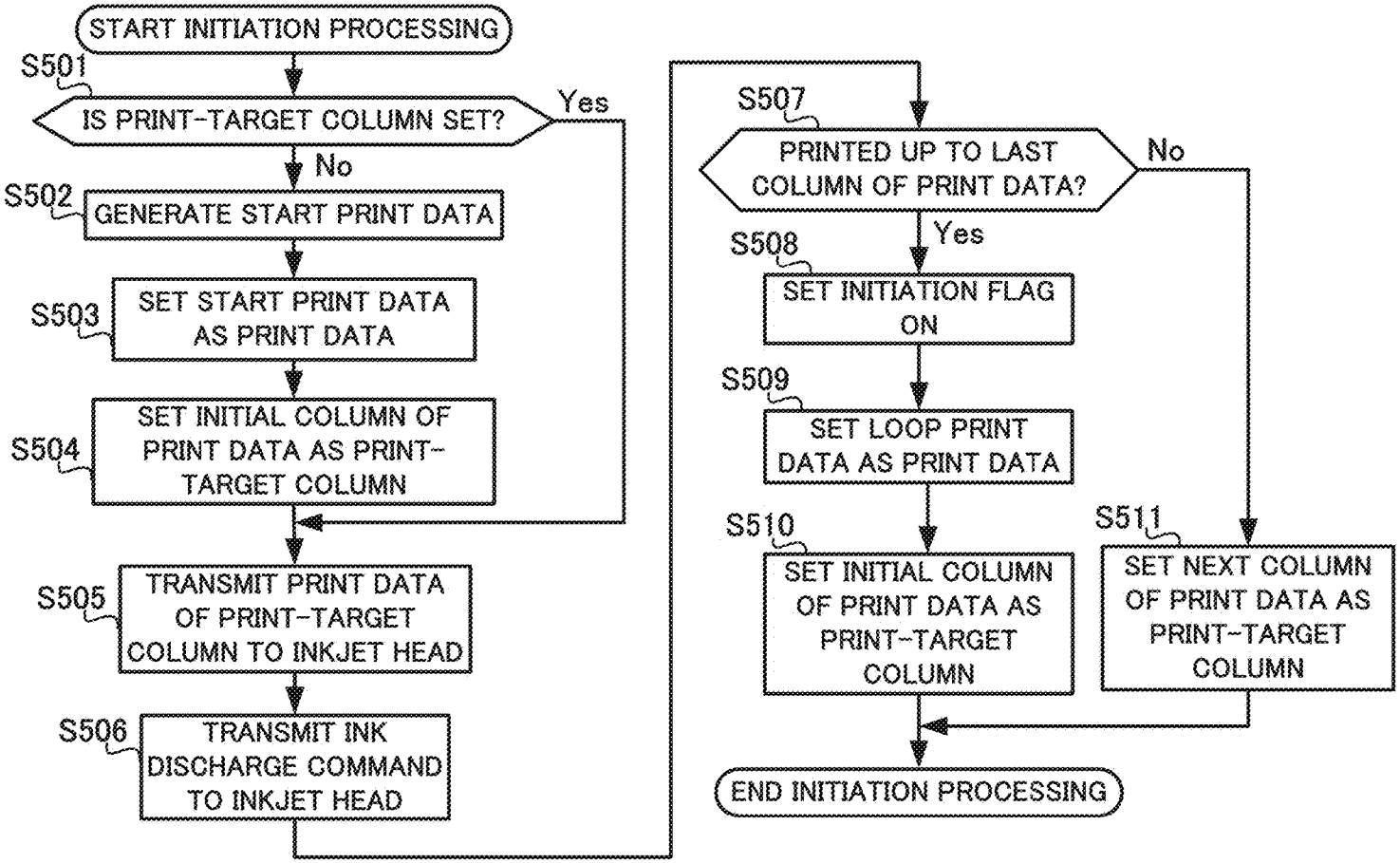
FIG. 21 is a flowchart for description of initiation processing executed by the printing apparatus according to the embodiment of the present disclosure.

FIGS. 16A and 16B illustrate an example in which the end button 105 is pushed down when printing is performed up to a data position u6 illustrated in FIG. 16A in accordance with the loop print data Dc. The data position u6 is the position that is located away from the 99th column, which is the last column, of the first nozzle array data D1 in the loop print data Dc by an adjustment data interval DM in rearward direction. In the example of FIGS. 16A and 16B, the adjustment data interval DM is a two-column portion distance in the data. By controlling the printer 107 in accordance with data of the data position u6 of the first nozzle array data D1, the image of a position s6 in the second image DW2 illustrated in FIG. 15 is printed by the first nozzle array L1. The position s6 is located away from the position s1 in rearward direction by an adjustment interval dm that is a distance corresponding to the adjustment data interval DM.

When the end button 105 is pushed down when the printing is performed up to the data position u6 in accordance with the loop print data Dc, the print controller 11 switches the print data to the second end print data Df illustrated in FIG. 16B in response. After switching of the print data, the print controller 11 starts the printing from a column next to a column corresponding to the data position u6. In response to the printing in accordance with the data of the last column of the second nozzle array data D2 in the second end print data Df, the print controller 11 ends printing. The last column of the second end print data Df illustrated in FIG. 16B is the 2nd column, which is the last column, of the second nozzle array data D2.

The second end print data Df is generated by the generator 10. Specifically, the generator 10 firstly erases the 2nd and subsequent columns, the 2nd column being the column corresponding to the data position u6 in the first nozzle array data D1 in the loop print data Dc. Then, the generator 10 copies an adjustment data interval DM portion from the 1st column, which is the initial column, of the second nozzle array data D2 in the normal print data Db (that is, the 1st and 2nd columns), and generates the second end print data Df by adding the copied data to the rear of the 99th column, which is the last column, of the second nozzle array data D2 in the loop print data Dc from which data is previously erased.

By controlling the printer 107 in accordance with the second end print data Df, the print controller 11 causes the first nozzle array L1 to end printing at the point s6 in the second image DW2. By controlling the printer 107 in accordance with the second end print data Df, the print controller 11 causes the second nozzle array L2 to print, after printing up to the right end of the first image DW1, the second image DW2 from the left end to the position s6 and stop printing. Upon execution of printing in accordance with the data of the last column of the second end print data Df, the print controller 11 ends the printing in the aforementioned manner By controlling the printer 107 in accordance with the start print data Dd at the start of the loop printing processing, and by controlling the printer 107 in accordance with the second end print data Df at the end of the loop printing processing, the print controller 11 suppresses the worsening of printing quality caused by printing of a part of the first image DW1 or the second image DW2 by only one nozzle array.

Hereinafter, printing processing executed by the printing apparatus 1 comprising aforementioned physical and functional configurations is described with reference to the flowcharts of FIGS. 17 to 24.

The printing apparatus 1 acquires the image data 109*b* from the external device via the wireless communication module 114 and stores the acquired data in the ROM 109. In this state, when the user selects the image data 109*b* that the user desires to print by operating the inputter 115, the control apparatus 108 starts the printing processing illustrated in the flowchart of FIG. 17.

Upon the start of the printing processing, firstly the generator 10 generates the binary image data Da by binarization processing of the selected image data 109*b* (step S101). The generator 10 generates the normal print data Db on the basis of the binary image data Da (step S102).

Next, the control apparatus 108 determines whether the loop flag is in the on state (step S103). Upon selection of the loop printing processing as the printing method by the user desiring the execution of the loop printing processing by pushing down of the loop switch button 104 an odd number of times, the input-output control circuit 117 in response sets the loop flag to the on state. In response, the control apparatus 108 determines that the loop flag is set in the on state (step S103; YES), and the generator 10 generates the loop print data Dc by execution of the loop print data generation processing (step S104). Details of the loop print data generation processing of the step S104 are described below with reference to the flowchart of FIG. 18.

Upon the start of the loop print data generation processing, the generator 10 firstly copies the first data range P1 of the normal print data Db (step S201). Next, the generator 10 calculates logical sum of the data of the first data range P1 of the normal print data Db copied in step S201 and the data of the third data range P3 of the normal print data Db (step S202). Then by erasing the first data range P1 of the normal print data Db, the generator 10 generates the loop print data Dc (step S203) and ends the loop print data generation processing.

Returning to FIG. 17, after the execution of the loop print data generation processing of step S104, the control apparatus 108 determines whether the print button 103 is pushed down (step S105). When it is determined that the print button 103 is not pushed down (step S105; NO), processing returns to step S105 and waits for pushing down of the print button 103.

When the user pushes down the print button 103 after placing the printing apparatus 1 at a desired printing start position on the printing medium 2, the control apparatus 108 in response determines that the print button 103 is pushed down (step S105; YES), sets the loop print data Dc generated in step S104 as the print data (step S106), and executes the loop printing processing (step S107). After pressing the print button 103 and giving an instruction to execute printing, the user helds the apparatus body 100 and moves the printing apparatus 1 in the movement direction. Hereinafter, details of the loop printing processing of step S107 are described with reference to the flowchart of FIG. 19.

Upon the start of the loop printing processing, the print controller 11 firstly sets and starts interruption for ink discharge processing (step S301). Thereafter, each time when the timer 118 detects elapsing of a print period set by a below-described sampling processing, the print controller 11 interrupts the ink discharge processing and repeatedly executes the ink discharge processing. Note that, at the start of the loop printing processing, the sampling processing is still not executed, and the print period to be set by the sampling processing is still not set. Thus at the start of the loop printing processing, an initial print period that is an initial value of the print period set previously by an arbitrary method such as experimentation is used. Hereinafter, details of the ink discharge processing are described with reference to the flowchart of FIG. 20.

Upon the start of the ink discharge processing, firstly the print controller 11 determines whether an initiation flag is in the on state (step S401). When it is determined that the initiation flag is not in the on state (step S401; NO), the print controller 11 executes the initiation processing (step S409). Hereinafter, details of the initiation processing are described with reference to the flowchart of FIG. 21.

Upon the start of the initiation processing, the print controller 11 firstly determines whether the print-target column is already set (step S501). If the initiation processing is executed one or more times already, the print-target column is set already, and thus the print controller 11 determines that the print-target column is already set (step S501; YES), and processing proceeds to step S505.

In the first initiation processing, for the print-target column is still not set, the print controller 11 determines that the print-target is still not set (step S501; NO). In response, the generator 10 generates the start print data Db (step S502). The print controller 11 sets the start print data Dd generated in step S502 as the print data (step S503) and sets the initial column of the start print data Dd as the print-target column (step S504). The initial column of the start print data Dd illustrated in FIG. 13 is the 1st column, which is the initial column, of the first nozzle array data D1.

The print controller 11 transmits the start print data Dd of the print-target column to the inkjet head 107*a* of the printer 107 (step S505). The print controller 11 transmits an ink discharge command to the inkjet head 107*a* and causes the discharging of the ink (step S506).

Next, the print controller 11 determines whether printing is already performed up to the last column of the start print data Dd (step S507). The last column of the start print data Dd illustrated in FIG. 13 is the 3rd column, which is the last column of the first nozzle array data D1. When it is determined that printing up to the final column of the start print data Dd is still not performed (step S507; NO), the print controller 11 sets the column next to the column printed immediately before in the start print data Dd as the print-target column (step S511) and ends the initiation processing.

On the other hand, when it is determined that printing up to the last column of the start print data Dd is already performed (step S507; YES), the print controller 11 sets the initiation flag to the on state (step S508). The print controller 11 sets the loop print data Dc as the print data (step S509), sets the initial column of the loop print data Dc as the print-target column (step S510), and ends the initiation processing. The initial column of the loop print data Dc illustrated in FIG. 10 is the 4th column, which is the initial column, of the first nozzle array data D1 and is the 1st column, which is the initial column, of the second nozzle array data D2.

Returning to FIG. 20, after the execution of the initiation processing of step S409, the print controller 11 ends the ink discharge processing.

When it is determined in step S401 that the initiation flag is set to the on state (step S401; YES), the print controller 11 determines whether the end button 105 is pushed down (step S402).

When it is determined that the end button 105 is not pushed down (step S402; NO), the print controller 11 transmits the loop print data Dc of the print-target column to the inkjet head 107*a* of the printer 107 (step S403). The print controller 11 transmits the ink discharge command to the inkjet head 107*a* and causes discharging of the ink (step S404).

Next, the print controller 11 determines whether printing up to the last column of the loop print data Dc is already performed (step S405). The last column of the loop print data Dc illustrated in FIG. 10 is the 3rd column, which is the final column, of the first nozzle array data D1 and is the 99th column, which is the last column, of the second nozzle array data D2. When it is determined that printing up to the last column of the loop print data Dc is already performed (step S405; YES), the print controller 11 sets the initial column of the loop print data Dc as the print-target column (step S406). The initial column of the loop print data Dc illustrated in FIG. 10 is the 4th column, which is the initial column, of the first nozzle array data D1 and is the 1st column, which is the initial column, of the second nozzle array data D2. When it is determined that printing up to the last column of the loop print data Dc is still not performed (step S405; NO), the print controller 11 sets the column next to the column printed immediately before in the loop print data Dc as the print-target column (step S407) and ends the ink discharge processing.

On the other hand, when it is determined that the end button 105 is pushed down (step S402; YES), the print controller 11 executes the halt processing (step S408). Hereinafter, details of the halt processing are described with reference to the flowchart of FIG. 22.

Upon the start of the halt processing, the print controller 11 firstly determines whether a halt flag is set to the on state (step S601). If the halt processing is already executed one time or more, the halt flag is set to the on state, and thus the print controller 11 determines the halt flag is set to the on state (step S601; YES), and processing proceeds to step S610.

In the first execution of the halt processing, for the halt flag is not set to the on state, the print controller 11 determines that the halt flag is not set to the on state (step S601; NO) and sets the halt flag to the on state (step S602).

When the end button 105 is pushed down, the print controller 11 acquires the data position of the loop print data Dc being printed by the first nozzle array L1 (step S603). The print controller 11 determines whether the image of the third area A2 or the image of the second area A3 of FIG. 15 is being printed by the first nozzle array L1 when the end button 105 is pushed down by determining whether the data position acquired in step S603 is between the data position u2 and the data position u3 illustrated in FIG. 14, FIG. 16A and FIG. 16B (step S604).

If the data position acquired in step S603 is located between the data position u2 and the data position u3, such as the data position u5 illustrated in FIG. 14A, it means that the first nozzle array L1 was printing the image in the third area A2 or the image in the second area A3 of FIG. 15 when the end button 105 is pushed down. In this case, when the print controller 11 determined that the data position acquired in step S603 is located between the data position u2 and the data position u3 (step S604; YES), the generator 10 generates the first end print data De (step S605). The print controller 11 sets the first end print data De generated in step S605 as the print data (step S606).

If the data position acquired in the step S603 is located between the data position u3 and the data position u4, such as the data position u6 illustrated in FIG. 16A, it means that the first nozzle array L1 was printing the image of the first area A1 in the second image DW2 of FIG. 15 when the end button 105 is pushed down. In this case, when the print controller 11 determined that the data position acquired in step S603 is not located between the data position u2 and the data position u3 (step S604; NO), the generator 10 generates the second end print data Df (step S608). The print controller 11 sets the second end print data Df generated in step 606 as the print data (step 609).

The print controller 11 sets the column next to the data position acquired in step S603 as the print-target column (step S607).

The print controller 11 transmits the print data of the print-target column to the inkjet head 107*a* of the printer 107 (step S610). The print controller 11 transmits the ink discharge command to the inkjet head 107*a* and causes the printer 107 to discharge the ink (step S611).

Next, the print controller 11 determines whether printing up to the last column of the print data is performed (step S612). The last column of the first end print data De illustrated in FIG. 14B is the 99th column, which is the last column, of the second nozzle array data D2. The last column of the second end print data Df illustrated in FIG. 16B is the 2nd column, which is the last column, of the second nozzle array data D2. When it is determined that the printing up to the last column of the print data is still not performed (step S612; NO), the print controller 11 sets the column next to the column printed immediately before in the print data as the print-target column (step S613) and ends the halt processing.

When it is determined that printing up to the last column of the print data is performed (step S612; YES), the print controller 11 sets a print completion flag to the on state (step S614) and ends the halt processing.

Returning to FIG. 20, after execution of the halt processing of step S408, the print controller 11 ends the ink discharge processing.

Returning to FIG. 19, after the start of the ink discharge processing in step S301, the control apparatus 108 sets and starts the interrupt for the sampling processing (step S302). Thereafter, each time the timer 118 detects elapsing of the sampling period previously set by the detecting apparatus 106, the control apparatus 108 interrupts the sampling processing and repeatedly executes the sampling processing. Hereinafter, details of the sampling processing are described with reference to the flowchart of FIG. 23.

Upon the start of the sampling processing, the control apparatus 108 firstly acquires from the detecting apparatus 106 a detection signal including the movement amount detection signal (step S701).

The control apparatus 108 determines whether the printing apparatus 1 is lifted off by determining whether the detection signal acquired in step S701 satisfies the predetermined lift-off condition (step S702). When it is determined that the printing apparatus 1 is lifted off (step S702; YES), for it is not desirable to continue discharging ink when the printing apparatus 1 is in the lifted-off state, the control apparatus 108 sets an error flag to on state (step S705), and ends the sampling processing.

When it is determined that the printing apparatus 1 is not lifted off (step S702; NO), the control apparatus 108 uses the movement amount detection signal included in the detection signal acquired in step S701 and calculates the movement speed of the printing apparatus 1 as a movement amount per sampling period (step S703).

The control apparatus 108 sets the printing period in accordance with the movement speed calculated in step S703 (step S704) and then ends the sampling processing.

The printing period is set by the sampling processing in the aforementioned manner, and the control apparatus 108 interrupts the sampling processing in each sampling period to repeatedly execute the sampling processing. Thus the printing period is updated in each sampling period.

Returning to FIG. 19, after starting the sampling processing of step S302, the control apparatus 108 determines whether the error flag is in the on state (step S303). When it is determined that the printing apparatus 1 is lifted off in the sampling processing of FIG. 23 (step S702; YES), the error flag is set to the on state (step S705). In response, the control apparatus 108 determines that the error flag is in the on state (step S303; YES), and processing proceeds to step S305.

When it is determined that the error flag is not in the on state (step S303; NO), the control apparatus 108 determines whether the print completion flag is in the on state (step S304). When it is determined that the print completion flag is not in the on state (step S304; NO), processing returns to step S303, and the control apparatus 108 waits for the end of printing or the occurrence of an error.

Figure 22:
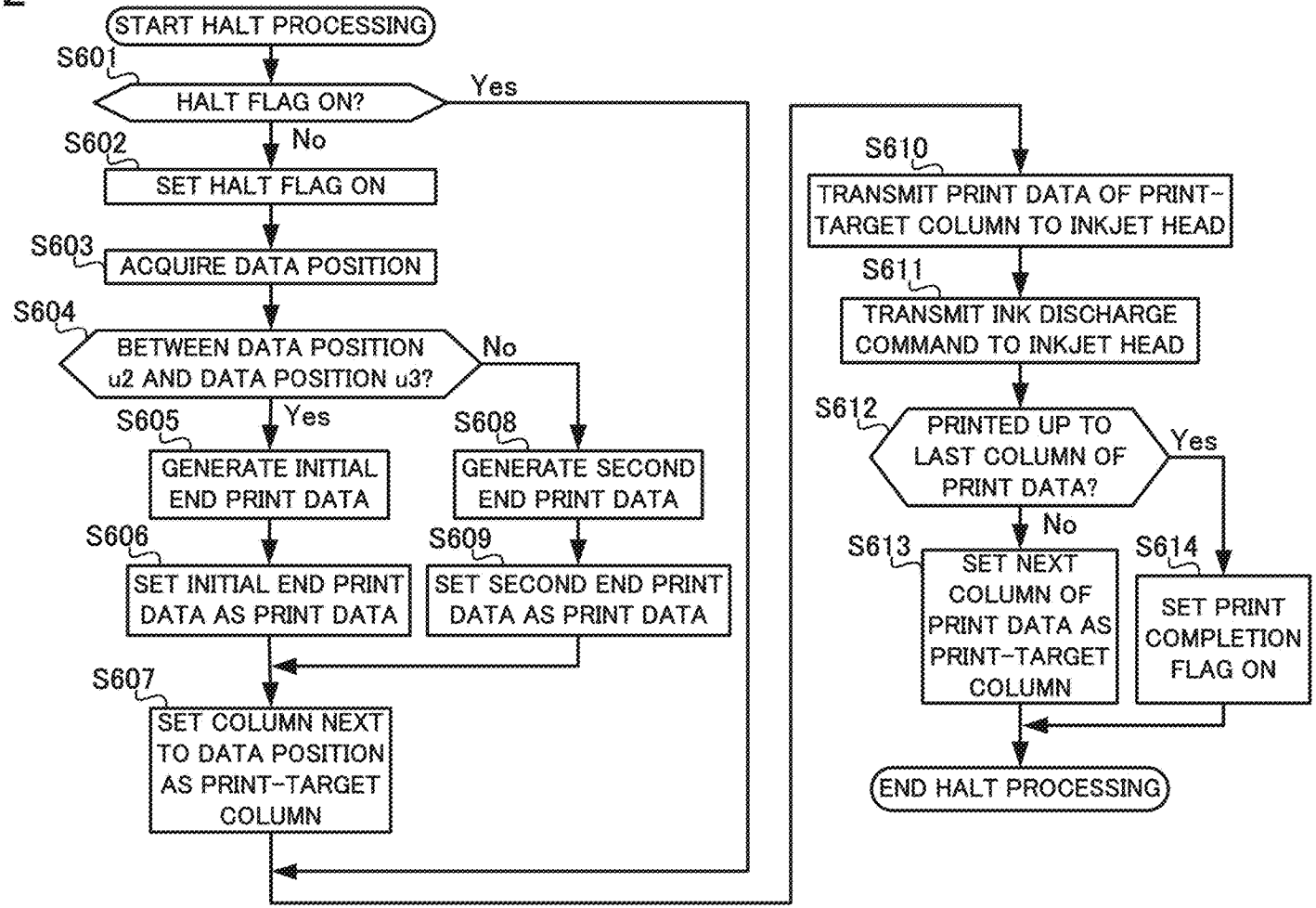
FIG. 22 is a flowchart for description of halt processing executed by the printing apparatus according to the embodiment of the present disclosure.
Figure 23:
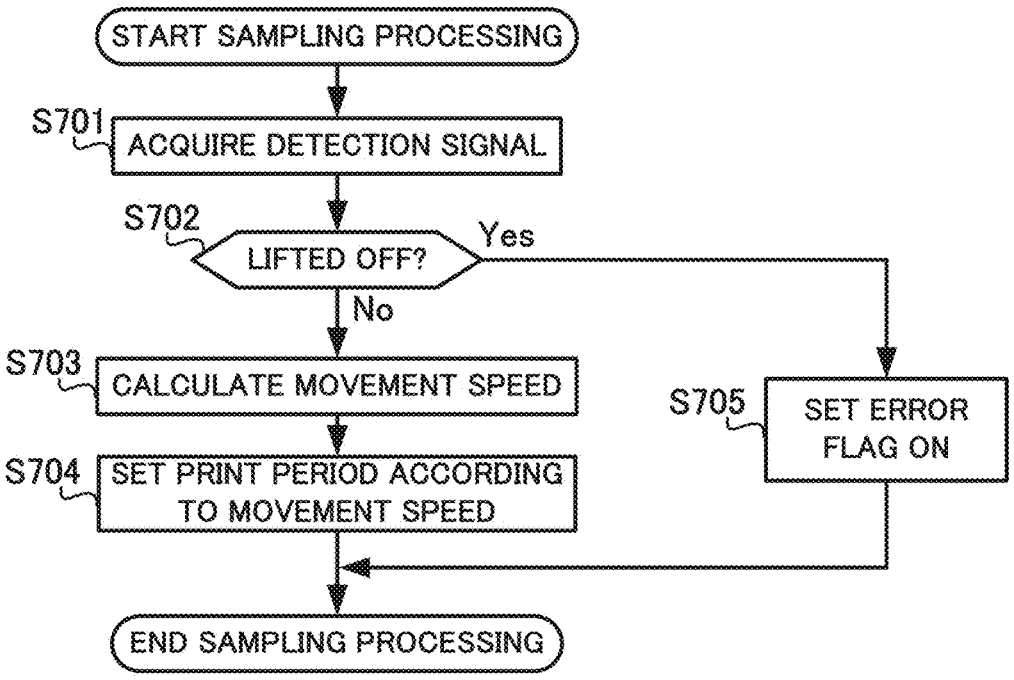
FIG. 23 is a flowchart for description of sampling processing executed by the printing apparatus according to the embodiment of the present disclosure.

When it is determined in the halt processing of FIG. 22 that printing up to the last column of the print data is performed (S612; YES), the print completion flag is set to the on state (step S614). In response, the control apparatus 108 determines that the print completion flag is in the on state (step S304; YES) and stops the interrupt for the ink discharge processing (step S305). The control apparatus 108 clears the loop flag, the initiation flag, the halt flag, and the print completion flag (step S306), stops the interrupt for the sampling processing (step S307), and ends the loop printing processing.

Returning to FIG. 17, after execution of the loop printing processing of step S107, the control apparatus 108 ends the printing processing.

When it is determined in step S103 that the loop flag is not in the on state (step S103; NO), the control apparatus 108 determines whether the print button 103 is pushed down (step S108). When it is determined that the print button 103 is not pushed down (step S108; NO), processing returns to step S103, and waits for an operation by the user.

When the user desiring execution of the normal printing processing places the printing apparatus 1 at the desired printing start position on the printing medium 2 and pushes down the print button 103 without selecting the loop printing processing as the printing method, the control apparatus 108 in response determines that the print button 103 is pushed down (step S108; YES), sets the normal print data Db generated in step S102 as the print data (step S109), and executes the normal printing processing (step S110).

Figure 24:
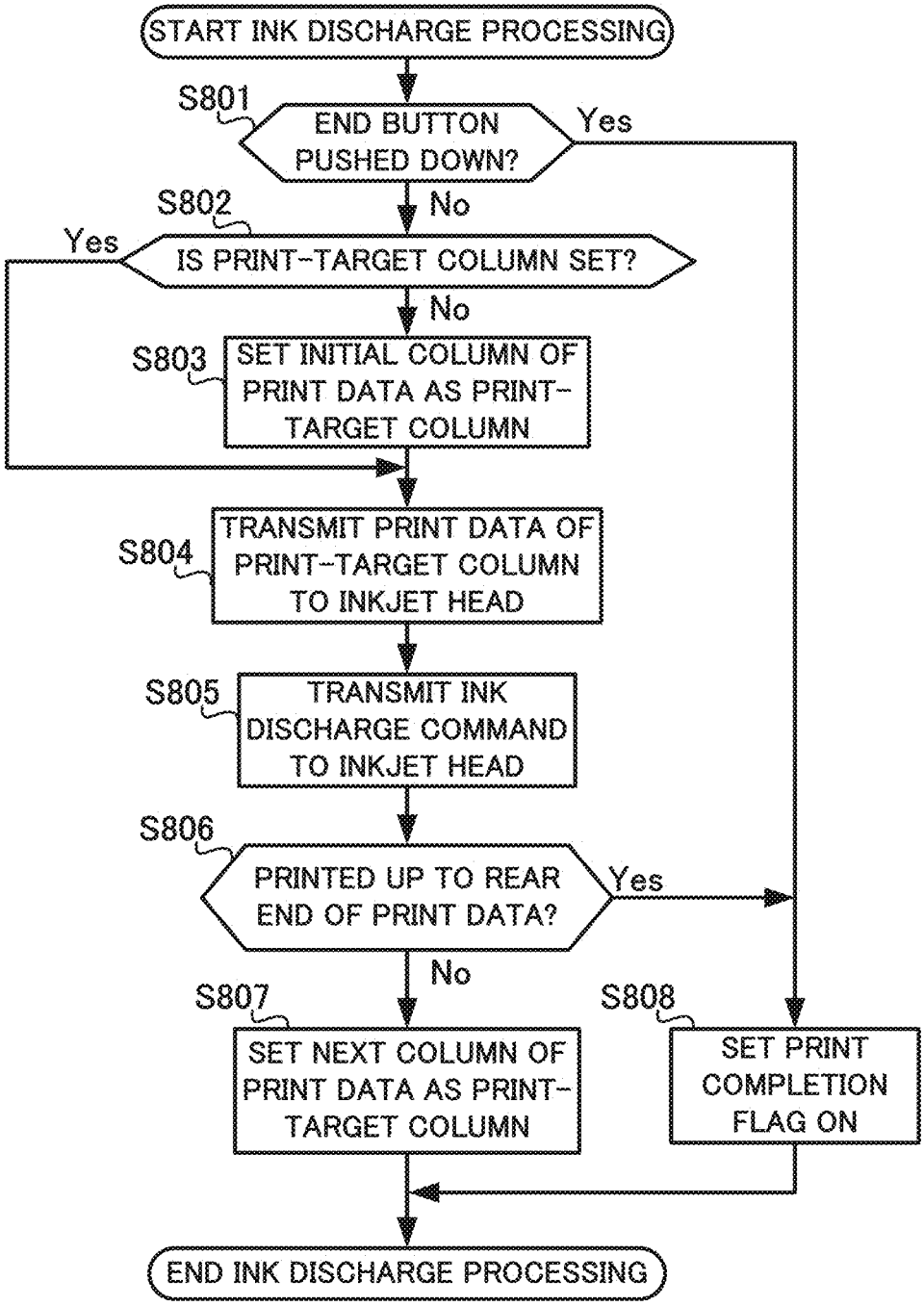
FIG. 24 is a flowchart for description of ink discharge processing executed by the printing apparatus according to the embodiment of the present disclosure in the normal printing processing.

The normal printing processing of step S110 is generally similar to the loop printing processing of step S107 except for the use of the normal print data Db for the print data instead of the loop print data Dc. Note that, in the normal printing processing, the ink discharge processing illustrated in the flowchart of FIG. 24 is executed instead of the ink discharge processing illustrated in the flowchart of FIG. 20. Hereinafter, details of the ink discharge processing executed in the normal printing processing are described with reference to the flowchart of FIG. 24.

When the ink discharge processing starts in the normal printing processing, the print controller 11 firstly determines whether the end button 105 is pushed down (step S801). When the user desiring the end of the normal printing processing pushes down the end button 105, the print controller 11 in response determines that the end button 105 is pushed down (step S801; YES), sets the print completion flag to the on state (step S808), and ends the ink discharge processing.

When it is determined that the end button 105 is not pushed down (step S801; NO), the print controller 11 determines whether the print-target column is set (step S802). When it is determined by the print controller 11 that the print-target column is set (step S802; YES), processing proceeds to step S804. When it is determined that the print-target column is not set (step S802; NO), the print controller 11 sets the initial column of the normal print data Db as the print-target column (step S803). The initial column of the normal print data Db illustrated in FIG. 7B is the 1st column, which is the initial column, of the first nozzle array data D1.

Next, the print controller 11 transmits the normal print data Db of the print-target column to the inkjet head 107*a* (step S804). The print controller 11 transmits the ink discharge command to the inkjet head 107*a* (step S805) and causes the printer 107 to discharge ink.

The print controller 11 determines whether printing up to the last column of the normal print data Db is performed (step S806). When it is determined that printing up to the last column of the normal print data Db is performed (step S806; YES), the print controller 11 sets the print completion flag to the on state (step S808) and ends the ink discharge processing.

When it is determined that printing up to the last column of the normal print data Db is not performed (step S806; NO), the print controller 11 sets the column next to the column printed immediately before as the print-target column (step S807) and ends the ink discharge processing.

Returning to FIG. 17, after execution of the normal printing processing of step S110, the control apparatus 108 ends the printing processing.

As described above, the printing apparatus 1, when continuously and repeatedly printing the single-unit image DW by discharging ink from multiple nozzle arrays in accordance with movement of the printing apparatus 1 by executing the loop printing processing, suppresses the generation of white lines at the boundaries between the single-unit image DW, and improves printing quality in comparison to repeated printing of the single-unit image DW by the normal printing processing.

The printing apparatus 1, by printing in accordance with the start print data Dd at the start of the loop printing processing, and by printing in accordance with the first end print data De at the end of the loop printing processing, suppresses worsening of printing quality, and suppresses cut off of printing of the single-unit image DW.

The printing apparatus 1, by printing in accordance with the start print data Dd at the start of the loop printing processing and by printing in according with the second end print data Df at the end of the loop printing processing, suppresses worsening of printing quality.

Although an embodiment of the present disclosure is described above, the above embodiment is an example, and the applicable scope of the present disclosure is not limited to the above embodiment. That is to say, various types of applications are possible for embodiments of the present disclosure, and all such embodiments are included in the scope of the present disclosure.

For example, in the above embodiment, the printing apparatus 1 is described to comprise two nozzle arrays. However, this configuration is merely an example, and the printing apparatus 1 may comprise an arbitrary number of the nozzle arrays. Specifically, the printing apparatus 1 may be a printing apparatus that prints the single-unit image DW in color by using inks of a plurality of colors and may comprise a plurality of nozzle arrays that discharges ink of each of the colors. Also in this case, by execution of processing similar to the above-described processing, the printing apparatus 1 can suppress the worsening of printing quality.

Figure 25:
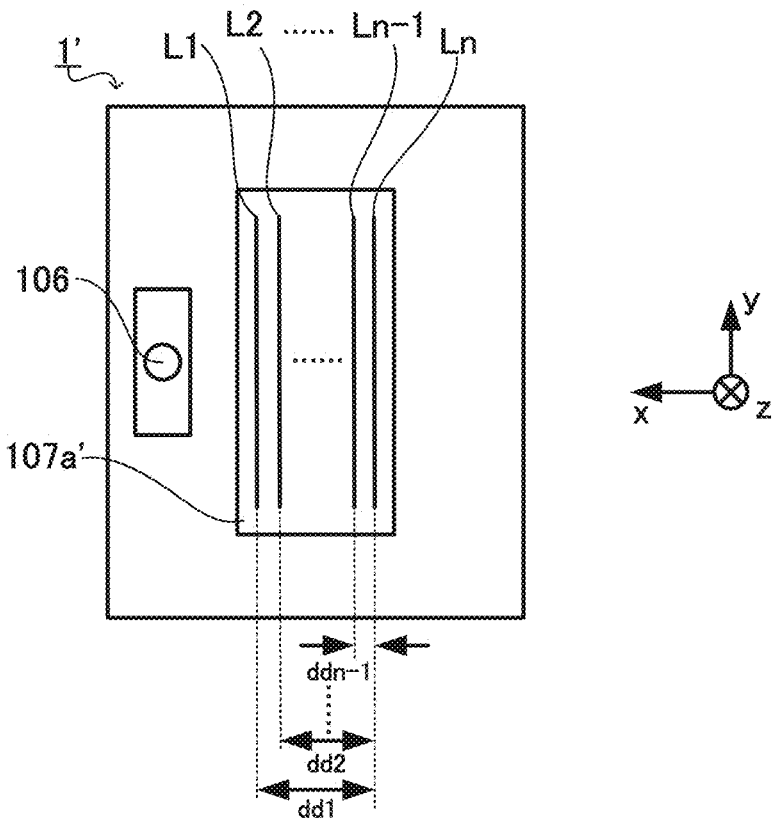
FIG. 25 is a bottom surface view of the printing apparatus according to a modified example of the present disclosure.

More specifically, a printing apparatus 1' may comprise nozzle arrays L1, L2, Ln as illustrated in FIG. 25. Here, n is any natural number greater than or equal to 3. As illustrated in FIG. 25, the first nozzle array L1 to the (n−1)th nozzle array Ln−1 are disposed away from the nth nozzle array Ln by mutually different nozzle array gaps dd1 to ddn−1 in the X-axis direction. The nth nozzle array Ln corresponds to the "second nozzle array" of the present disclosure, and the second nozzle array L2 to the (n−1) th nozzle array Ln−1 correspond to the "other nozzle array" of the present disclosure.

Figure 26:
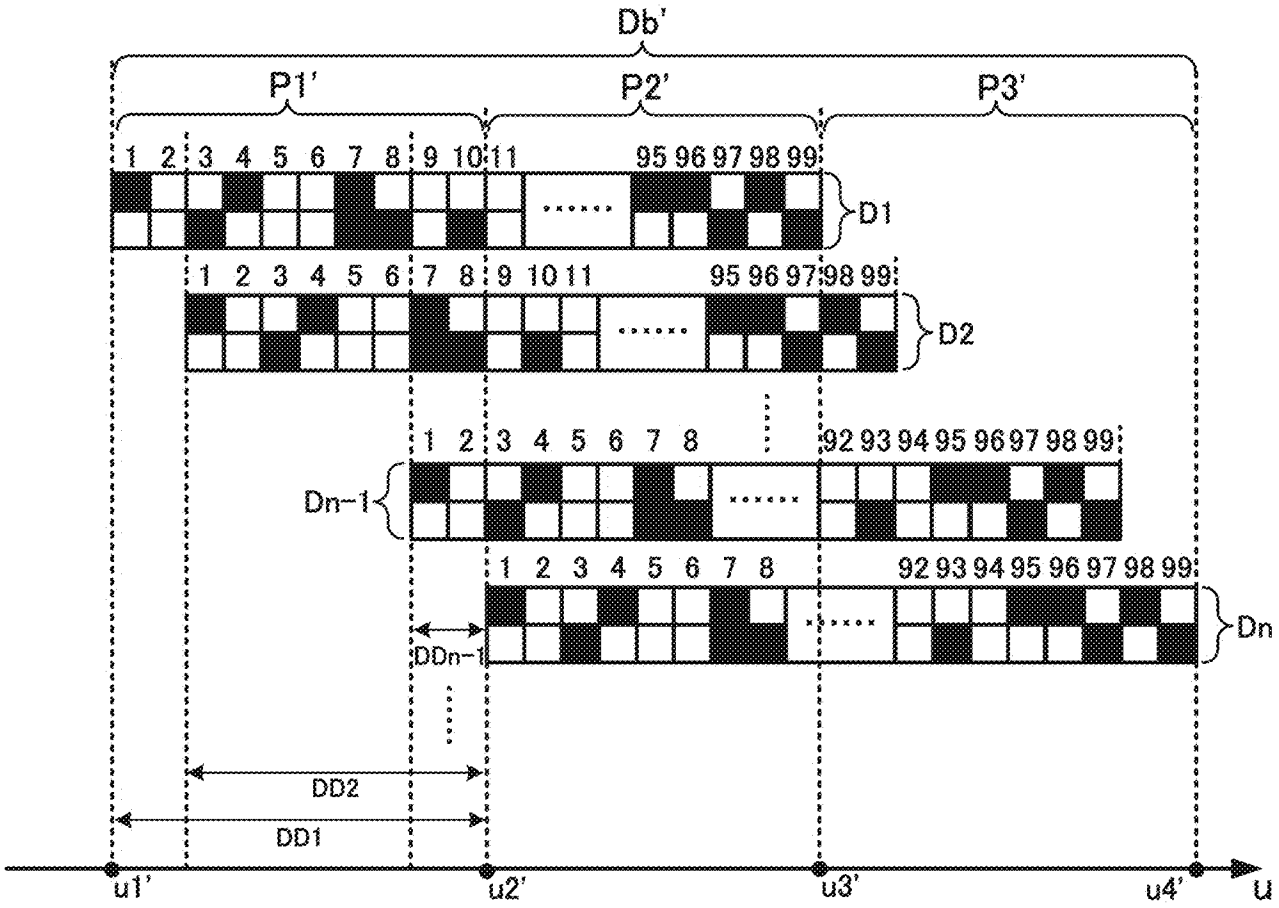
FIG. 26 is a drawing illustrating an example configuration of the normal print data used by the printing apparatus according to the modified example of the present disclosure in the normal printing processing.

The printing apparatus 1' executes the normal printing processing in accordance with normal print data Db' illustrated in FIG. 26. The normal print data Db' is generated by the generator 10. The generator 10 generates the normal print data Db' by associating nozzle array data D1' to Dn' which correspond to nozzle arrays L1 to Ln each other. Specifically, the generator 10 generates the normal print data Db' by disposing the first nozzle array data D1' to the (n−1)th nozzle array data Dn−1' so that the initial column of each of data is disposed away from the initial column of the nth nozzle array data Dn' by data distances DD1 to DDn−1 which correspond to the nozzle array gaps dd1 to ddn−1 corresponding to each of data in forward direction. For example, in the normal print data Db' illustrated in FIG. 26, the 1st column, which is the initial column, of the nth nozzle array data Dn' is associated with the 11th column of the first nozzle array data D1'.

The nozzle array data D1' to Dn' is generated on the basis of the binary image data. When the single-unit image DW is printed in color using multiple colors of ink, binary image data is generated corresponding to each of the colors, and the nozzle array data D1' to Dn' are generated using the binary image data corresponding to each of these colors.

A data position u1' of FIG. 26 is a data position of the 1st column, which is the initial column of the first nozzle array data D1'. A data position u2' is a data position of the 1st column, which is the initial column of the nth nozzle array data Dn'. A data position u3' is a data position of the 99 column, which is the last column, of the first nozzle array data D1'. A data position u4' is a data position of the 99 column, which is the last column, of the nth nozzle array data Dn'. A 1st data range P1' is a range of the data between the data position u1' and the data position u2'. A second data range P2' is a range of the data between the data position u2' and the data position u3'. A third data range P3' is a range of the data between the data position u3' and the data position u4'.

Figure 27:
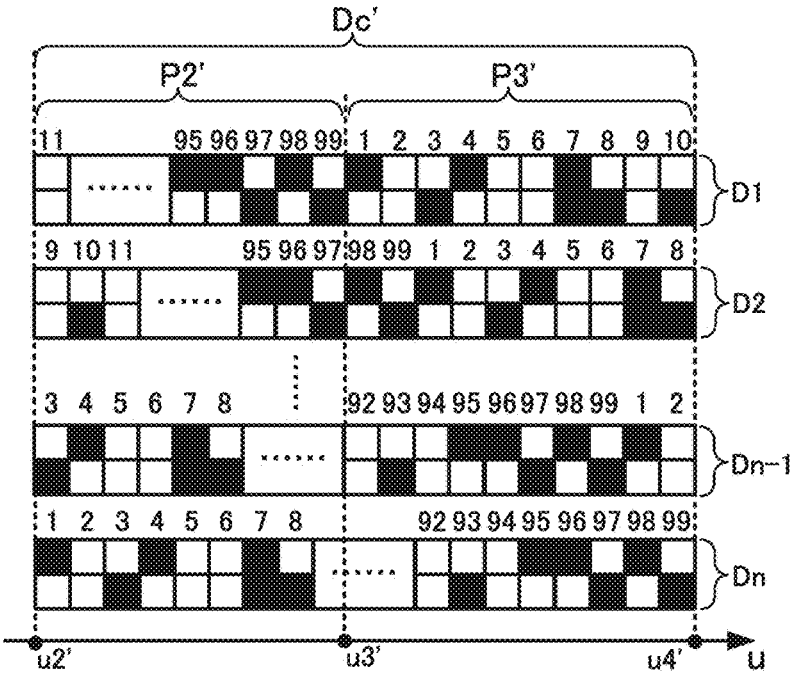
FIG. 27 is a drawing illustrating an example configuration of loop print data used by the printing apparatus according to the modified example of the present disclosure in the loop printing processing.

The printing apparatus 1' executes the loop printing processing in accordance with the loop print data Dc' illustrated in FIG. 27. The loop print data Dc' is generated by the generator 10. In the normal print data Db' illustrated in FIG. 26, the generator 10 copies the data distance DD1 to DDn−1 portions corresponding to each data from the first column of the initial nozzle array data D1' to the (n−1)th nozzle array data Dn−1'. Then the generator 10 adds the copied data rearward of the last column of each data. Then the generator 10 erases the data of the copying source to generate the loop print data Dc'.

By controlling the printer 107 in accordance with the data of the second data range P2' of the loop print data Dc', the print controller 11 causes the first nozzle array L1 to print the image of the third area A2 and the image of the second area A3 in the first image DW1 of FIG. 11, and the print controller 11 causes the nth nozzle array Ln to print the image of the first area A1 and the image of the third area A2 in the first image DW1. By controlling the printer 107 in accordance with the data of the second data range P2' of the loop print data Dc', the print controller 11 causes the second nozzle array L2 to the (n−1)th nozzle array Ln−1 to print a part of the image of the first area A1, the image of the third area A2, and a part of the image of the second area A3 in the first image DW1.

By controlling the printer 107 in accordance with the data of the third data range P3' of the loop print data Dc', the print controller 11 causes the first nozzle array L1 to print the image of the first area A1 in the second image DW2, and causes the nth nozzle array Ln to print the image of the second area A3 in the first image DW1. By controlling the printer 107 in accordance with the data of the third data range P3' of the loop print data Dc', the print controller 11 causes the second nozzle array L2 to the (n−1)th nozzle array Ln−1 to print the image of another part of the image of the second area A3 in the first image DW1, and the image of another part of the first area A1 in the second image DW2.

Figure 28:
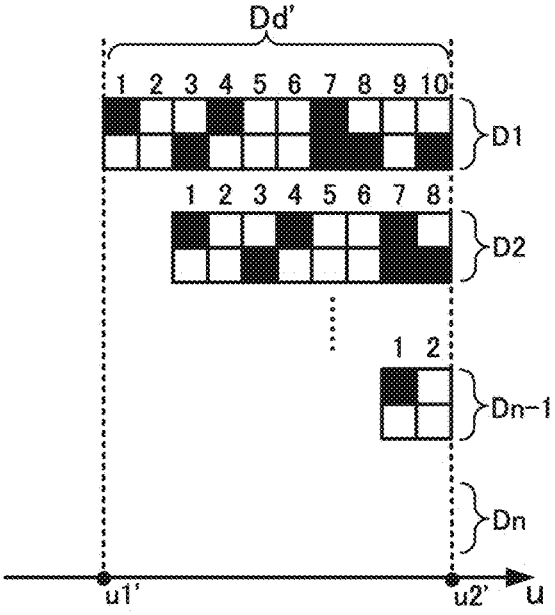
FIG. 28 is a drawing illustrating an example configuration of start print data used by the printing apparatus according to the modified example of the present disclosure when starting the loop printing processing.

At the start of the loop printing processing, the printing apparatus 1' executes printing in accordance with the start print data Dd' illustrated in FIG. 28. The start print data Dd' is generated by the generator 10. The generator 10 generates the start print data Dd' by copying the first data range P1 of the normal print data Db'.

Figure 29:
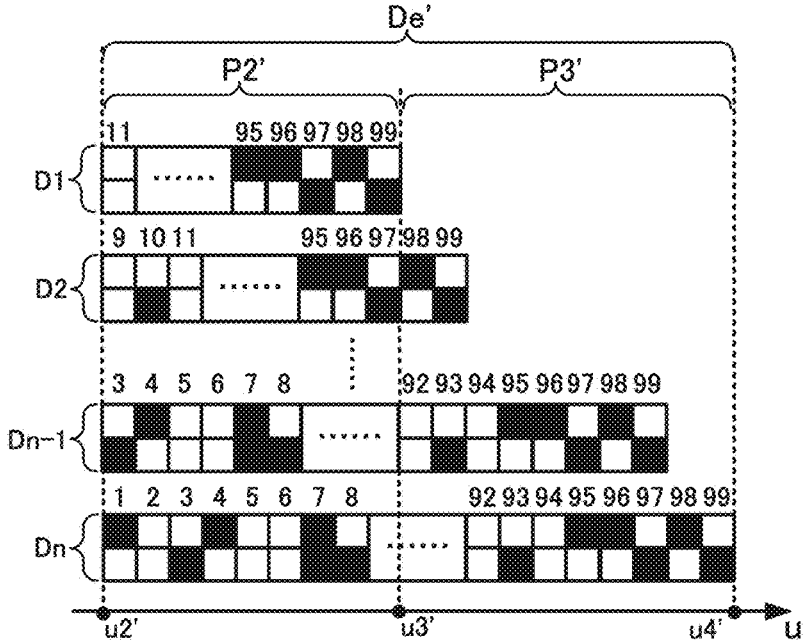
FIG. 29 is a drawing illustrating an example configuration of first end print data used by the printing apparatus according to the modified example of the present disclosure when ending the loop printing processing.

When the end button 105 is pushed down during printing of the image of the third area A2 or the image of the second area A3 of FIG. 8 by the first nozzle array L1, the printing apparatus 1' executes printing in accordance with the first end print data De' illustrated in FIG. 29. The first end print data De' is generated by the generator 10. The generator 10 generates the first end print data De' by erasing, in the loop print data Dc', the data between the last column of the first nozzle array data D1' to the nth nozzle array data Dn' and the last column of the loop print data Dc'.

Figure 30:
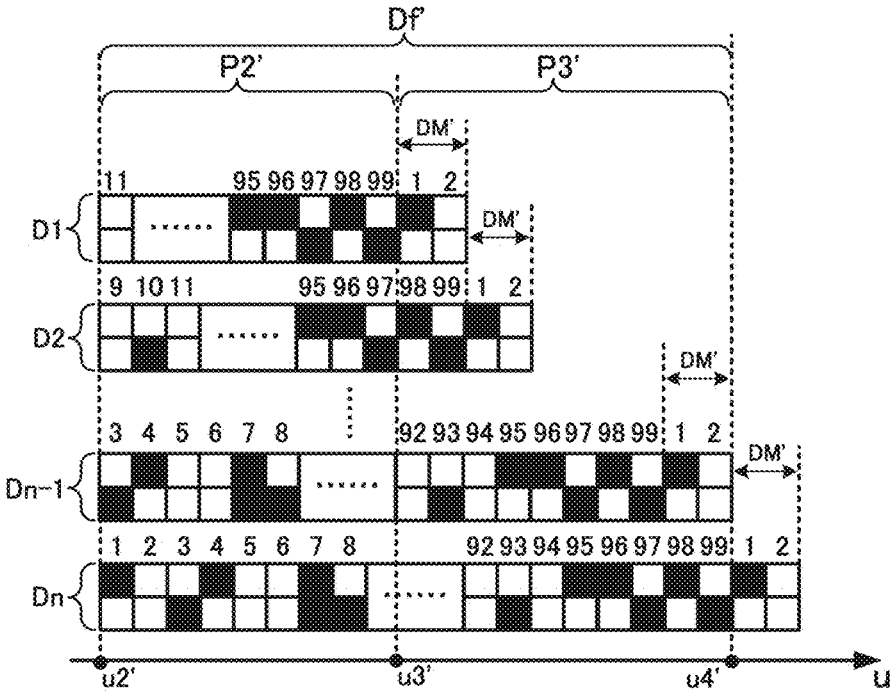
FIG. 30 is a drawing illustrating an example configuration of second end print data used by the printing apparatus according to the modified example of the present disclosure when ending the loop printing processing.

When the end button 105 is pushed down during the printing of the image of the first area A1 of FIG. 8 by the first nozzle array L1, the printing apparatus 1' executes printing in accordance with the second end print data Df illustrated in FIG. 30. The second end print data Df is generated by the generator 10. Specifically, in the first nozzle array data D1' in the loop print data Dc', the generator 10 firstly erases the data at and subsequent to the data position being printed by the first nozzle array L1 when the end button 105 is pushed down. Next, the generator 10 copies an adjustment data interval DM' portion from the 1st column, which is the initial column, of the second nozzle array data D2' to the nth nozzle array data Dn' in the normal print data Db', and adds the copied data rearward of the last column of the second nozzle array data D2' to the nth nozzle array data Dn' of the erased loop print data Dc' to generate the second end print data Df. The adjustment data interval DM' is the distance in the data between the last column of the second data range P2' and the data position being printed by the first nozzle array L1 when the end button 105 is pushed down.

Figure 31A:
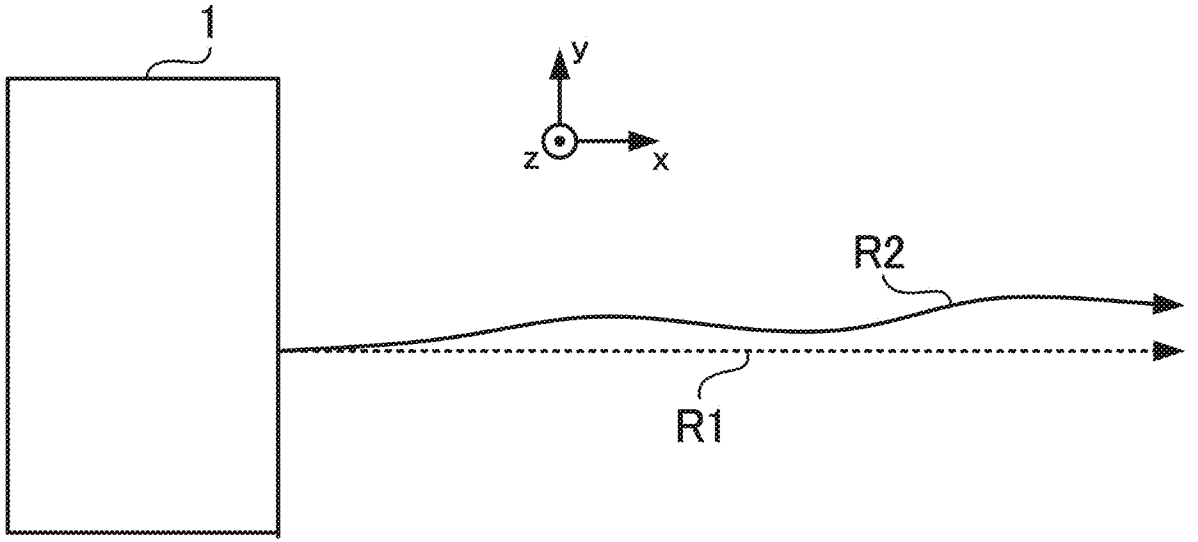
FIG. 31A and FIG. 31B are drawings for description of results of printing and a movement direction during printing by the printing apparatus according to the modified example of the present disclosure.
Figure 31B:
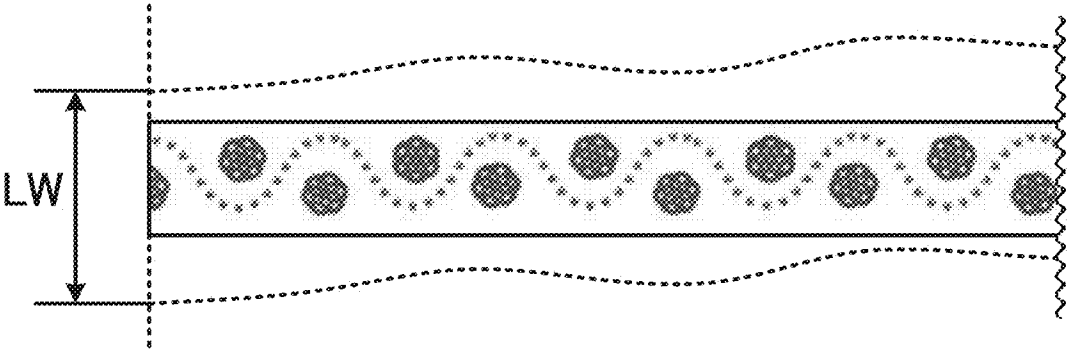

The movement direction of the printing apparatus 1 is described to be X-axis direction in the aforementioned embodiments. However, the movement direction may deviate somewhat from the X-axis direction. When the movement direction of the printing apparatus is R2 as illustrated in FIG. 31A and the movement direction R2 deviates from a direction R1, which is the direction along the X-axis direction, the print controller 11, on the basis of the movement amount detection signal from the detecting apparatus 106, acquires a deviation of this movement direction R2 relative to the direction R1 as needed. Then the print controller 11 causes the printer 107 to execute printing while adjusting the position of printing by the printer 107 as required, as illustrated in FIG. 31B. Thus as illustrated in FIG. 31B, results of printing are obtained that are the same as the results of printing in the case where the printing apparatus 1 moves in the direction R1 along the X-axis direction.

Although printing is described to be performed by the printer 107 by the inkjet method in the aforementioned embodiments, printing may be performed by methods such as thermosensitive printing or thermal-transfer printing.

The aforementioned embodiments described the case of repeated printing of the single-unit image DW. However, each of the images printed adjacent to each other may be mutually different images. The generation of gaps between each of the printed images can be eliminated also in such a case.

In the aforementioned embodiments, the first nozzle array L1 and the second nozzle array L2 are described to be disposed at positions that are mutually the same in the Y-axis direction as illustrated in FIG. 3. However, this configuration is merely an example, and the first nozzle array L1 and the second nozzle array L2 may be disposed at positions that are mutually displaced from each other in the Y-axis direction.

In the aforementioned embodiments, the ink nozzles n1, n3, . . . n13 included in the first nozzle array L1 and the ink nozzles n2, n4, . . . n14 included in the second nozzle array L2 are described to be disposed at positions mutually displaced from each other in the Y-axis direction as illustrated in FIG. 4. However, this configuration is merely an example, and the ink nozzles n1, n3, . . . n13 included in the first nozzle array L1 and the ink nozzles n2, n4, . . . n14 included in the second nozzle array L2 may be disposed at mutually the same positions in the Y-axis direction.

In the aforementioned embodiments, the generator 10 is described to use the binary image data Da to generate the normal print data Db and the loop print data Dc. However, these embodiments are merely examples. The generator 10 may use multi-valued image data having three or more values to generate the normal print data Db and the loop print data Dc. Specifically, the printing apparatus 1 in this case may be a printing apparatus that prints the single-unit image DW in grayscale format by discharging ink droplets with various dot diameters, and the printing apparatus 1 may execute printing in accordance with the multi-valued image data having three or more values that indicate, rather than only whether or not to discharge ink, what dot diameter of ink droplet is to be discharged. In this case, the generator 10 may generate the normal print data Db and the loop print data Dc by executing a processing in accordance with the multi-value image data of three or more values which is similar to the above-described processing in accordance with the binary image data Da.

In the aforementioned embodiments, the pushing down of the end button 105 is described to correspond to "end condition being met". However, this configuration is merely an example, and the "end conditions" can be set arbitrary. For example, the movement amount of the printing apparatus 1 exceeding a predetermined threshold may be set as the "end conditions". Alternatively, the "end conditions" may be set to be the printing of the single-unit image DW a predetermined number of times.

In the aforementioned embodiments, the printing apparatus 1 is described to, when the end button 105 is pushed down during printing of the image of the third area A2 or the image of the second area A3 by the first nozzle array L1, prints up to the right end of the printing-in-progress single-unit image DW and then ends printing. However, this configuration is merely an example. The printing apparatus 1 may, when the end button 105 is pushed down during printing of the image of the third area A2 or the image of the second area A3 by the first nozzle array L1, print up to the position being printed by the first nozzle array L1 when the end button 105 is pushed down in the single-unit image DW, and then end printing.

In the aforementioned embodiments, the printing apparatus 1 is described to, when the end button 105 is pushed down during printing of the image of the third area A2 or the image of the second area A3 by the first nozzle array L1, prints up to the position in the single-unit image DW being printed by the first nozzle array L1 when the end button 105 is pushed down, and then ends printing. However, this configuration is merely an example. The printing apparatus 1 may, when the end button 105 is pushed down during printing by the first nozzle array L1 of the image of the third area A2 or the image of the second area A3, print up to the right end of the printing-in-progress single-unit image DW, and then end printing.

In the aforementioned embodiments, the binary image data Da, the normal print data Db, and the loop print data Dc are described to be generated by the printing apparatus 1. However, this configuration is merely an example. These data may be generated by an external device, and the generated data may be acquired by the printing apparatus 1 via the wireless communication module 114.

In the aforementioned embodiments, the printing apparatus 1 is described as a manually-scanning-type printing apparatus. However, this configuration is merely an example. The printing apparatus 1 may be an self-propelling-type printing apparatus that comprises movement means for causing movement of the printing apparatus 1 on the printing medium 2 and executes printing in accordance with the movement.

In the aforementioned embodiments, the printing apparatus 1 is described to acquire the image data 109*b* from the external device via the wireless communication module 114. However, this configuration is merely an example. The printing apparatus 1 may acquire the image data 109*b* by any method. For example, the printing apparatus 1 may comprise a wired communication interface such as a universal serial bus (USB) port and may acquire the image data 109*b* from the external device via the wired communication interface. Alternatively, the printing apparatus 1 may acquire the image data 109*b* by receiving input of the image data 109*b* by the user using the inputter 115.

In the aforementioned embodiments, the notifier 116 is described to notify the user that printing is in progress by turning on the first LED 101 and notify the user that the loop printing processing is selected as the printing method by turning on the second LED 102. However, this configuration is merely an example. The notifier 116 can perform notification by any method. For example, the notifier 116 may comprise a display apparatus such as a liquid crystal panel and the like, and perform various types of notification by displaying images on the display apparatus.

In the aforementioned embodiments, the detecting apparatus 106 is described to comprise a laser-type optical sensor. However, this configuration is merely an example. The detecting apparatus 106 can detect the movement amount of the printing apparatus 1 and the lifting off of the printing apparatus 1 by any sensor. For example, the detecting apparatus 106 may comprise an LED-type optical sensor, irradiate light from an LED light source onto the surface of the printing medium 2, and output the movement amount detection signal by imaging and analyzing shadows generated by surface irregularities of the printing medium 2.

Note that, while it is needless to say that a printing apparatus that previously comprises a configuration to realize the function according to the present disclosure can be provided as a printing apparatus according to the present disclosure, it is also possible to make an existing printing apparatus to function as the printing apparatus according to the present disclosure by applying thereto a program. That is, by applying a program for realizing each functional component of a printing apparatus according to the present disclosure so that a computer that controls the existing printing apparatus can execute the program, the existing printing apparatus can be made to function as the printing apparatus according to the present disclosure.

Note that any method can be used to apply such a program. For example, the program can be applied by being stored in a computer-readable storage medium such as a flexible disk, a compact disc (CD)-ROM, a digital versatile disc (DVD)-ROM, or a memory card, and the like. Further, it is also possible to superpose the program on a carrier wave and apply the program via a communication network such as the Internet and the like. For example, the program may be posted and distributed on a bulletin board (BBS: Bulletin Board System) on the communication network. Then, it may be configured to execute the above-described processing by activating and executing the program under the control of the operating system (OS) just as the other application programs.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing apparatus comprising:

a printer that prints a print image based on print data on a printing medium; and a processor that controls printing by the printer;

wherein:

the printer comprises a first printing nozzle array and a second printing nozzle array, printing by one of the first printing nozzle array and the second printing nozzle array being performed based on odd numbered lines of the print data and printing by the other of the first printing nozzle array and the second printing nozzle array being performed based on even numbered lines of the print data, the first printing nozzle array and the second printing nozzle array being separated by a first length from each other along a first direction, extending along a second direction intersecting the first direction, and being provided such that a position of the first printing nozzle array is displaced from a position of the second printing nozzle array by half of a length between adjacent nozzles of the second printing nozzle array in the second direction, the print image has a first end and a second end along the first direction and is divided into a first area image provided at a side of the first end, a second area image provided at a side of the second end, and a third area image provided between the first area image and the second area image, and the processor is operable to, when the printer performs loop printing from the first end toward the second end on the printing medium by the first printing nozzle array and the second printing nozzle array while the printer moves in a movement direction in which the first printing nozzle array is in front of the second printing nozzle array:

(1) create first frame print data of the print image including first print data, second print data, and third print data so that printing is performed in order of the third print data, the second print data, and the first print data, the first print data including one of odd numbered lines and even numbered lines of the print data corresponding to the first area image, the second print data including one of odd numbered lines and even numbered lines of the print data corresponding to the second area image, and the third print data including one of odd numbered lines and even numbered lines of the print data corresponding to the third area image;

(2) create second frame print data of the print image including fourth print data, fifth print data, and sixth print data so that printing is performed in order of the fourth print data, the sixth print data, and the fifth print data, the fourth print data including the other of the odd numbered lines and the even numbered lines of the print data corresponding to the first area image, the fifth print data including the other of the odd numbered lines and the even numbered lines of the print data corresponding to the second area image, and the sixth print data including the other of the odd numbered lines and the even numbered lines of the print data corresponding to the third area image; and (3) in a case of repeatedly printing loop print data including the first frame print data and the second frame print data by the first printing nozzle array and the second printing nozzle array, respectively, execute a first control operation in which printing of the second area image in a first print image as the print image, based on the print data, by the second printing nozzle array is performed in parallel with printing of a fourth area image in a second print image as the print image, based on the same print data on which printing of the first print image is based, the fourth area image being provided in an area of the second print image corresponding to an area of the first print image in which the first area image is provided, and the fourth area image being printed at a position adjacent to the second end by the first printing nozzle array.

2. The printing apparatus according to claim 1, wherein:

in the first print image, the first area image is an image being printed in an area having the first length along the first direction and has an end being a starting end of the first print image, the second area image is an image being printed in an area having the first length along the first direction and has an end being a finishing end of the first image, and the third area image is an image that has one end adjacent to the first area image and the other end adjacent to the second area image, and in the second print image, the fourth area image is an image being printed in an area having the first length along the first direction and has an end being a starting end of the second print image.

3. The printing apparatus according to claim 1, wherein the processor causes the printer to print, when the printer prints the first print image while moving in the movement direction, by the first printing nozzle array and the second printing nozzle array, the first area image, the third area image, and the second area image in the first print image in order along the first direction.

4. The printing apparatus according to claim 1, wherein, when the printer prints the second print image at a position adjacent to the second end of the first print image that is printed on the printing medium by the first printing nozzle array and the second printing nozzle array while the printer moves in the movement direction, the processor executes a second control operation, prior to execution of the first control operation, in which printing of the first area image and the third area image in the first print image by the second printing nozzle array is performed in parallel with printing of the third area image and the second area image in the first print image by the first printing nozzle array.

5. The printing apparatus according to claim 4, wherein after performance of an operation to cause a start of printing, prior to execution of the second control operation, the processor executes a start control operation to cause the second printing nozzle array to start printing of the first area image in the first print image when printing by the first printing nozzle array of the first area image in the first print image is ended.

6. The printing apparatus according to claim 5, wherein after performance of the operation to cause the start of printing, the processor causes repeated execution, in order, of the first control operation and the second control operation while an operation to cause an end of printing is not performed.

7. The printing apparatus according to claim 4, wherein:

the print head further comprises at least one other printing nozzle array disposed between the first printing nozzle array and the second printing nozzle array, in the first control operation, the processor causes, in parallel with printing of a part of the second area image in the first print image by the second printing nozzle array, printing of another part of the second area image in the first print image and another part of the fourth area image in the second print image at a position adjacent to the second end of the first print image that is printed by the other printing nozzle array, and in the second control operation, the processor causes, in parallel with printing of a part of the first area image and a part of the third area image in the first print image by the second printing nozzle array, printing of another part of the third area image and another part of the second area image in the first print image by the other printing nozzle array.

8. The printing apparatus according to claim 7, wherein, when an operation to cause an end of printing is performed during execution of the second control operation, the processor causes an end of printing, in order, from a printing nozzle array that completed printing of the second area image of the first print image, from among a plurality of printing nozzle arrays.

9. The printing apparatus according to claim 7, wherein, when an operation to cause an end of printing is performed during execution of the first control operation, the processor causes an end of printing by the first printing nozzle array, and an end of printing, in order, from a printing nozzle array that completed printing at a same position as a position where the first printing nozzle array printed the fourth area image in the second print image when the operation to cause the end of printing is performed.

10. A printing method executed by a printing apparatus, the printing apparatus comprising a printer that prints a print image based on print data on a printing medium, the printer comprising a first printing nozzle array and a second printing nozzle array, printing by one of the first printing nozzle array and the second printing nozzle array being performed based on odd numbered lines of the print data and printing by the other of the first printing nozzle array and the second printing nozzle array being performed based on even numbered lines of the print data, the first printing nozzle array and the second printing nozzle array being separated by a first length from each other along a first direction, extending along a second direction intersecting the first direction, and being provided such that a position of the first printing nozzle array is displaced from a position of the second printing nozzle array by half of a length between adjacent nozzles of the second printing nozzle array in the second direction, the print image having a first end and a second end along the first direction and being divided into a first area image provided at a side of the first end, a second area image provided at a side of the second end, and a third area image provided between the first area image and the second area image, and the printing method comprising:

when the printer performs loop printing from the first end toward the second end on the printing medium by the first printing nozzle array and the second printing nozzle array while the printer moves in a movement direction in which the first printing nozzle array is in front of the second printing nozzle array:

(1) creating first frame print data of the print image including first print data, second print data, and third print data so that printing is performed in order of the third print data, the second print data, and the first print data, the first print data including one of odd numbered lines and even numbered lines of the print data corresponding to the first area image, the second print data including one of odd numbered lines and even numbered lines of the print data corresponding to the second area image, and the third print data including one of odd numbered lines and even numbered lines of the print data corresponding to the third area image;

(2) creating second frame print data of the print image including fourth print data, fifth print data, and sixth print data so that printing is performed in order of the fourth print data, the sixth print data, and the fifth print data, the fourth print data including the other of the odd numbered lines and the even numbered lines of the print data corresponding to the first area image, the fifth print data including the other of the odd numbered lines and the even numbered lines of the print data corresponding to the second area image, and the sixth print data including the other of the odd numbered lines and the even numbered lines of the print data corresponding to the third area image; and (3) in a case of repeatedly printing loop print data including the first frame print data and the second frame print data by the first printing nozzle array and the second printing nozzle array, respectively, executing a first control operation in which printing of the second area image in a first print image as the print image, based on the print data, by the second printing nozzle array is performed in parallel with printing of a fourth area image in a second print image as the print image, based on the same print data on which printing of the first print image is based, the fourth area image being provided in an area of the second print image corresponding to an area of the first print image in which the first area image is provided, and the fourth area image being printed at a position adjacent to the second end by the first printing nozzle array.

11. The printing method according to claim 10, wherein:

in the first print image, the first area image is an image being printed in an area having the first length along the first direction and has an end being a starting end of the first print image, the second area image is an image being printed in an area having the first length along the first direction and has an end being a finishing end of the first print image, and the third area image is an image that has one end adjacent to the first area image and the other end adjacent to the second area image, and in the second print image, the fourth area image is an image being printed in an area having the first length along the first direction and has an end being a starting end of the second print image.

12. The printing method according to claim 10, further comprising causing the printer to print, when the printer prints the first print image while moving in the movement direction, by the first printing nozzle array and the second printing nozzle array, the first area image, the third area image, and the second area image in the first print image in order along the first direction.

13. The printing method according to claim 10, wherein, when the printer prints the second print image at a position adjacent to the second end of the first print image that is printed on the printing medium by the first printing nozzle array and the second printing nozzle array while the printer moves in the movement direction, the method further comprises executing a second control operation, prior to execution of the first control operation, in which printing of the first area image and the third area image in the first print image by the second printing nozzle array is performed in parallel with printing of the third area image and the second area image in the first print image by the first printing nozzle array.

14. The printing method according to claim 13, further comprising, after performance of an operation to cause a start of printing, prior to execution of the second control operation, executing a start control operation to cause the second printing nozzle array to start printing of the first area image in the first print image when printing by the first printing nozzle array of the first area image in the first print image is ended.

15. The printing method according to claim 14, further comprising, after performance of the operation to cause the start of printing, causing repeated execution, in order, of the first control operation and the second control operation while an operation to cause an end of printing is not performed.

16. The printing method according to claim 13, wherein the print head further comprises at least one other printing nozzle array disposed between the first printing nozzle array and the second printing nozzle array, and the method further comprises:

in the first control operation, causing, in parallel with printing of a part of the second area image in the first print image by the second printing nozzle array, printing of another part of the second area image in the first print image and another part of the fourth area image in the second print image at a position adjacent to the second end of the first print image that is printed by the other printing nozzle array; and in the second control operation, causing, in parallel with printing of a part of the first area image and a part of the third area image in the first print image by the second printing nozzle array, printing of another part of the third area image and another part of the second area image in the first print image by the other printing nozzle array.

17. The printing method according to claim 16, further comprising, when an operation to cause an end of printing is performed during execution of the second control operation, causing an end of printing, in order, from a printing nozzle array that completed printing of the second area image of the first print image, from among a plurality of printing nozzle arrays.

18. The printing method according to claim 16, further comprising, when an operation to cause an end of printing is performed during execution of the first control operation, causing an end of printing by the first printing nozzle array, and an end of printing, in order, from a printing nozzle array that completed printing at a same position as a position where the first printing nozzle array printed the fourth area image in the second print image when the operation to cause the end of printing is performed.

19. A non-transitory computer-readable recording medium storing a printing control program that controls a printing apparatus, the printing apparatus comprising a printer that prints a print image based on print data on a printing medium, the printer comprising a first printing nozzle array and a second printing nozzle array, printing by one of the first printing nozzle array and the second printing nozzle array being performed based on odd numbered lines of the print data and printing by the other of the first printing nozzle array and the second printing nozzle array being performed based on even numbered lines of the print data, the first printing nozzle array and the second printing nozzle array being separated by a first length from each other along a first direction, extending along a second direction intersecting the first direction, and being provided such that a position of the first printing nozzle array is displaced from a position of the second printing nozzle array by half of a length between adjacent nozzles of the second printing nozzle array in the second direction, the print image having a first end and a second end along the first direction and being divided into a first area image provided at a side of the first end, a second area image provided at a side of the second end, and a third area image provided between the first area image and the second area image, and the printing control program being executable by a computer of the printing apparatus to control the printing apparatus to:

when the printer performs loop printing from the first end toward the second end on the printing medium by the first printing nozzle array and the second printing nozzle array while the printer moves in a movement direction which the first printing nozzle array is in front of the second printing nozzle array:

(1) create first frame print data of the print image including first print data, second print data, and third print data so that printing is performed in order of the third print data, the second print data, and the first print data, the first print data including one of odd numbered lines and even numbered lines of the print data corresponding to the first area image, the second print data including one of odd numbered lines and even numbered lines of the print data corresponding to the second area image, and the third print data including one of odd numbered lines and even numbered lines of the print data corresponding to the third area image;

(2) create second frame print data of the print image including fourth print data, fifth print data, and sixth print data so that printing is performed in order of the fourth print data, the sixth print data, and the fifth print data, the fourth print data including the other of the odd numbered lines and the even numbered lines of the print data corresponding to the first area image, the fifth print data including the other of the odd numbered lines and the even numbered lines of the print data corresponding to the second area image, and the sixth print data including the other of the odd numbered lines and the even numbered lines of the print data corresponding to the third area image; and (3) in a case of repeatedly printing loop print data including the first frame print data and the second frame print data by the first printing nozzle array and the second printing nozzle array, respectively, execute a first control operation in which printing of the second area image in a first print image as the print image, based on the print data, by the second printing nozzle array is performed in parallel with printing of a fourth area image in a second print image as the print image, based on the same print data on which printing of the first print image is based, the fourth area image being provided in an area of the second print image corresponding to an area of the first print image in which the first area image is provided, and the fourth area image being printed at a position adjacent to the second end by the first printing nozzle array.

* * * * *